US011291253B2

(12) United States Patent
Kuo et al.

(10) Patent No.: US 11,291,253 B2
(45) Date of Patent: Apr. 5, 2022

(54) ELECTRONIC CIGARETTE CARTRIDGE TUBE AND METHOD FOR PREPARING THE SAME

(71) Applicant: Golden Arrow Printing Technology (Kunshan) Co., LTD., Suzhou (CN)

(72) Inventors: Chien-Kuan Kuo, New Taipei (TW); Chun-Huang Huang, New Taipei (TW)

(73) Assignee: GOLDEN ARROW PRINTING TECHNOLOGY (KUNSHAN) CO., LTD., Suzhou (CN)

( * ) Notice: Subject to any disclaimer, the term of this patent is extended or adjusted under 35 U.S.C. 154(b) by 328 days.

(21) Appl. No.: 16/726,793

(22) Filed: Dec. 24, 2019

(65) Prior Publication Data

US 2021/0045446 A1 Feb. 18, 2021

(30) Foreign Application Priority Data

Aug. 13, 2019 (CN) ..... 201910744226.5

(51) Int. Cl.

| | |
|---|---|
| ***A24F 40/70*** | (2020.01) |
| *A24F 40/46* | (2020.01) |
| *A24F 40/42* | (2020.01) |
| *A24B 3/14* | (2006.01) |

(52) U.S. Cl.

CPC ..... *A24F 40/70* (2020.01); *A24B 3/14* (2013.01); *A24F 40/42* (2020.01); *A24F 40/46* (2020.01)

(58) Field of Classification Search

CPC ..... A24F 40/70

See application file for complete search history.

(56) References Cited

U.S. PATENT DOCUMENTS

2004/0013830 A1* 1/2004 Nonomura ..... B32B 1/02 428/34.2
2014/0353867 A1* 12/2014 Liu ..... B29C 45/57 264/51

(Continued)

FOREIGN PATENT DOCUMENTS

CN 1107464 C 5/2003
CN 102334751 B 7/2013

(Continued)

*Primary Examiner* — James Harvey
(74) *Attorney, Agent, or Firm* — Cheng-Ju Chiang

(57) ABSTRACT

An electronic cigarette cartridge tube and a method for preparing the same is introduced herein. Both of a filter tip and a cartridge container of the electronic cigarette cartridge tube are made respectively by consistent-and-continuous production machines used with a pulp-molding fabrication approach which is researched and improved, thereby integrally forming a solid geometrical shape of any one of the filter tip and the cartridge container. It can not only resolve the technical problems of the existing pulp-molding fabrication method that is incapable of producing a component (e.g. a cylinder-shaped longitudinal filter tip or cartridge container) of a cylinder-shaped lengthwise electronic cigarette cartridge tube, having a ratio, greater than one, of a maximum longitudinal height thereof being relative to a maximum transverse width thereof, but can also save its working cycle time, benefit its mass production, and assure its higher product yield and quality.

19 Claims, 10 Drawing Sheets

(56) References Cited

U.S. PATENT DOCUMENTS

| | | | | |
|---|---|---|---|---|
| 2016/0168801 | A1* | 6/2016 | Kuo | D21J 3/00 162/194 |
| 2021/0045446 | A1* | 2/2021 | Kuo | A24F 42/80 |
| 2021/0047784 | A1* | 2/2021 | Kuo | D21J 1/02 |
| 2021/0345686 | A1* | 11/2021 | Rogan | A24F 40/20 |

FOREIGN PATENT DOCUMENTS

| | | | |
|---|---|---|---|
| CN | 103271447 | A | 9/2013 |
| CN | 104411191 | A | 3/2015 |
| CN | 104114050 | B | 1/2019 |

* cited by examiner

ELECTRONIC CIGARETTE CARTRIDGE TUBE AND METHOD FOR PREPARING THE SAME

FIELD OF THE INVENTION

The present invention relates to an electronic cigarette cartridge tube and a method for preparing the same, and especially relates to an electronic cigarette cartridge tube which is applicable for automated production.

BACKGROUND OF THE INVENTION

Current electronic cigarettes are structured roughly with an electrically-smoking cartridge and an atomizer. Said electrically-smoking cartridge further comprises a filter tip made of filtration materials, and an electrically-smoking cartridge container operable to internally store a cartridge body. Said cartridge body is made of at least one material comprising one or combination of a number of tobacco materials, aerosol-forming materials, smoke oils, e-liquid/e-juice, flavors and so forth. A heating element outwardly protruded from the atomizer is operable to be inserted into a distal end of the cartridge container, for heating the material of said cartridge body stored inside the cartridge container and therefore atomizing the material of said cartridge body. For example, after an e-liquid/e-juice is atomized to form an aerosol, the aerosol is filtrated by and passes through the filter tip, and then is inhaled into a smoker's mouth. In respect of the components of which the current electronic cigarette cartridge tube is structured, please refer to Chinese patent issued Nos. CN103271447A, CN1041140508 and CN104411191A.

In respect of the components/compositions which the current filter tip is structured and composed of, please further refer to Chinese patent issued Nos. CN1107464C and CN102334751B, which respectively introduce a method or a composition for preparing a smoking filter. Said smoking filter is made of fibrous materials which contain paper pulp fibers and cellulose acetates. Firstly, the paper pulp fibers and the cellulose acetates (or other chemical fibers) that are mixed together are made into a planar paper substrate by a conventional planarization manufacturing technology so that the planar paper substrate is rolled into a paper core; and then a circumference of said paper core is wrapped by a forming paper piece, thereby completing the preparation of said smoking filter, whereas its manufacturing cost is higher, and the cellulose acetates (or other chemical fibers) are prone to pollute the natural environment and harmful to the human health. The Chinese patent issued number CN102334751B publishes that the fibrous materials of the smoking filter further contains polylactic acid (PLA) fibers; nevertheless as known so far, if it is required to make the PLA fibers fulfilling its natural degradation, it is essential to satisfy the following strictly degradable conditions, which comprise a relative humidity of 90% remaining in the natural environment and a temperature remaining higher than 60 degrees, during a degrading time continuing for over one month; and thereupon it is unable to really accomplish the environmental requirements for the biodegradability or the compostability.

Nowadays, although there is an existing pulp-molding fabrication method (or called 'wet fibrous pulp molding') which is applicable to integrally form a variety of huge paper packaging for 3C products. In the existing pulp-molding fabrication method, the plant fibers and/or wastepaper treated as fundamental raw material are compressed by a production machine equipped with a male and female mold assembly, for integrally forming the variety of the huge 3C paper packaging. Please refer to FIG. 1, which schematically depicts a prior production line 10 operating with the existing pulp-molding fabrication method. The prior production line 10 includes a pulp-dredging and pre-compression apparatus 20, a paper-article-shaping thermo-compression forming apparatus 30 and a paper-article-shaping cutting apparatus 36. A slurry 28 is formed by disintegrating, beating and dispersing said raw material, and then is stored with a slurry tank 26. In the pulp-dredging and pre-compression apparatus 20, a first lower female mold 24 is employed to collectively dredge wet plant fibrous body containing a large amount of moisture therein, from within said slurry tank 26, such that the wet plant fibrous body is contained or fills within a depression 242 defined on an upper surface of the first lower female mold 24; and next, the pulp-dredging and pre-compression apparatus 20 exerts a pressure to make a first upper male mold 22 and the first lower female mold 24 both mutually matched, namely that a projection 222 formed on a bottom surface of the first upper male mold 22 acts to slightly and downwardly pre-compress the wet plant fibrous body within said depression 242, thereby forming a paper article (or called 'wet billet') 12 containing rich wet plant fibrous body while a water vapor and/or moisture contained within the wet plant fibrous body is exhausted partially in a vacuum exhausting manner.

Nevertheless, the existing pulp-molding fabrication method that employs the first lower female mold 24 to collectively dredge the wet plant fibrous body is prone to incur the following technical problems: (1) Said depression 242 operable for collectively dredging the wet plant fibrous body has a vertically-forming depth H1, and a ratio R1 of the vertically-forming depth H1 being relative to a transversely-forming width W1 of each side of said depression 242, which is limited to be smaller than or equal to 1 (i.e. H1/W1=R1, R1≤1), thereby correspondingly shaping a made-of-paper packaging 16 in revealing a compact box which mostly follows to have a transverse width w1' being equal to a longitudinal height h1' or a transverse width w1' being greater than a longitudinal height h1' (i.e. h1'/w1'=r1, r1≤1). It is difficult to produce a cylinder-shaped longitudinal paper article which is designed with a ratio r1, greater than one, of a longitudinal height h1' being relative to a transverse width w1' (i.e. h1'/w1'=r1, r1>1). A reason why it is difficult to produce is that if a size of the transversely-forming width W1 of said depression 242 is modified smaller than that of its vertically-forming depth H1, a pressuring area of the bottom surface of said projection 222 has to follow with correspondingly-decreased modification for the mutual match. While said projection 222 of the first female mold 22 that has a smaller pressuring area pre-compresses the wet plant fibrous body within said depression 242, under a manner that a thrust force 'F' applied by the apparatus 20 is constant, the smaller the pressuring area of said projection 222 is modified, the larger the pressure P is applied onto the wet plant fibrous body having a large water-containing amount, pursuant to the pressure formula: F/A=P (Pressure). Further pursuant to Pascal's principle, a too large pressure P would increase a force strength to force the wet plant fibrous body instantly overflowing more, through a crack between the two mutually-matched male and female molds 22, 24, from the inside of said depression 242 to the outside of said depression 242, functioning as same as an outward injection done by a small-area injection passage of a piston type syringe. Simultaneously, the deeper the vertically-forming depth H1 of said depression 242 is formed (as an injecting stroke of a syringe), the more the overflowing amount of the wet plant fibrous body further overflows outwardly. It should be noted that, while there is the more overflowing amount of the wet plant fibrous body flowing out of said depression 242 through the crack between the two mutually-matched male and female molds 22, 24, it is very prone to invoke said made-of-paper packaging 16 formed with an insufficient structural thickness and/or structural strength, and even a structural break problem. This would incur its product yield lowered and its quality difficult of assurance; and (2) In the existing pulp-molding fabrication method, it is difficult to integrally form the made-of-paper packaging 16 with a partial structure having a transverse width W1' of less than 8 mm. Depending on the afore-mentioned technical problems, currently it is difficult to adopt the existing pulp-molding fabrication method on massively-and-automatically producing a cylinder-shaped lengthwise cigarette cartridge tube which is structured of a transverse width smaller than a longitudinal height thereof.

Hence, it is essential to provide an electronic cigarette cartridge tube and a method for preparing the same, for resolving the afore-mentioned technical problems of the prior arts.

SUMMARY OF THE INVENTION

To resolve the afore-mentioned technical problems of the prior arts, a primary objective of the present invention is to provide an electronic cigarette cartridge tube and a method for preparing the same. The electronic cigarette cartridge tube has a filter tip and a cartridge container, both of which are respectively made by consistent-and-continuous production machines used with an identical pulp-molding fabrication method which has been researched and improved, thereby individually or simultaneously integrally forming a solid geometrical shape of both the filter tip and the cartridge container. This leads to not only resolving the technical problems of the existing pulp-molding fabrication method that is incapable of producing the respective components of a cylinder-shaped lengthwise cigarette cartridge tube (e.g. a longitudinally elongated filter tip or a cartridge container), which has a ratio, greater than one, of its maximum longitudinal height being relative to its maximum transverse width, but also saving its working cycle time, benefiting its mass production, assuring its higher product yield and quality.

Another objective of the present invention is to provide an electronic cigarette cartridge tube and a method for preparing the same, which treats pure plant fibers as a material for constituting the entire electronic cigarette cartridge tube. Accordingly, it can achieve a great filtration capacity, a low-cost advantage, non-occurrence of both healthy doubt and food safety problem for the human body, and conforming with FDA food-grade certification standard, thereby actually accomplishing an environmental protection requirement for both biodegradability and compostability.

Another objective of the present invention is to provide an electronic cigarette cartridge tube and a method for preparing the same, which treats pure plant fibers as a material for constituting the entire electronic cigarette cartridge tube, thereby making the electronic cigarette cartridge tube to have a better flame retardance (i.e. a lower ignition temperature) and a great oil resistance, and which has a filter tip designed with a hollow chamber constructed of an inner curve surface, thereby expediting an air ventilation inside the electronic cigarette while a consumer smokes the electronic cigarette, so as to fulfill a goal of rapidly reducing the temperature.

To accomplish the afore-mentioned objectives, the present invention adopts the following technical solutions. A method for preparing an electronic cigarette cartridge tube that comprises a filter tip and a cartridge container, comprises the steps as follows.

A pulp-dredging and pre-compression step comprises the steps of: sinking a first male mold within a slurry tank, and then only by way of vacuum exhausting, adsorbing a wet plant fibrous body onto and around an entire outer circumferential surface of each of a plurality of spaced-apart first upright posts located on the first male mold; and then making a first female mold and the first male mold both mutually matched for pre-compressing the wet plant fibrous body therebetween, thereby forming a wet paper article, which is constructed of the wet plant fibrous body, located between the first female mold and the first male mold, wherein each of the first upright posts is protruded outside an upper surface of the first male mold, a plurality of spaced-apart first vertical pits are formed inwardly on from a bottom surface of the first female mold, and the plurality of first vertical pits respectively correspond to the plurality of first upright posts in a deployed arrangement and sized proportion, and each of the first vertical pits and the respective corresponding first upright post both are mutually matched, commonly along a respective corresponding longitudinally-elongated center line, such that each of the first upright posts has a maximum first-upright-post width formed perpendicular to the respective corresponding longitudinally-elongated center line, a maximum first-upright-post height formed parallel to the respective corresponding longitudinally-elongated center line, and a ratio, greater than one, of the maximum first-upright-post height being relative to the maximum first-upright-post width, and each of the first vertical pits has a maximum first-vertical-pit width formed perpendicular to the respective corresponding longitudinally-elongated center line, a maximum first-vertical-pit formed parallel to the respective corresponding longitudinally-elongated center line, and a ratio, greater than one, of the maximum first-vertical-pit depth being relative to the maximum first-vertical-pit width.

After implementing the pulp-dredging and pre-compression step, a thermo-compression forming step is implemented, which comprises the steps of: positioning the wet paper article into between a second female mold and a second male mold; making the second female mold and the second male mold both mutually matched for thermally compressing the wet paper article located therebetween; and by the way of vacuum exhausting, exhausting a portion of water vapor and/or moisture contained within the wet paper article, and thereby drying the wet paper article, wherein a plurality of spaced-apart second upright posts are disposed, on an upper surface of the second male mold, with the same deployed arrangement and the same sized proportion as using in forming the plurality of first upright posts, and a plurality of spaced-apart second vertical pits are inwardly formed, from a bottom surface of the second female mold, with the same deployed arrangement and the same sized proportion as used in forming the plurality of first vertical pits.

After the thermo-compression forming step, a cutting step is implemented, which comprises the steps of: cutting away a superfluous portion from the dried paper article; by implementing the cutting step, making the dried paper article respectively forming a top distal end, a top opening on the top distal end, a bottom distal end opposite to the top distal end, and a bottom opening on the bottom distal end, wherein the bottom distal end has a maximum transverse width formed dependent on the maximum first-vertical-pit width, and the dried paper article is either of the filter tip and the cartridge container, which has a maximum longitudinal height formed, from the top distal end to the bottom distal end, between both the maximum first-vertical-pit height and the maximum first-upright-post height, and a ratio, greater than one, of the maximum longitudinal height being relative to the maximum transverse width.

Preferably, each of the first upright posts has a free terminal and a junction terminal formed, with the maximum first-upright-post width, oppositely to the free terminal, and connected to the upper surface of the first male mold.

Preferably, each of the first upright posts further has a longitudinal outermost wall surface which is an outer curve surface formed, with the maximum first-upright-post height, between the free terminal and the junction terminal, around the respective corresponding longitudinally-elongated center line, thereby making the dried paper article correspondingly forming a hollow chamber and a longitudinal innermost wall surface to construct the hollow chamber, between both the top distal end and the bottom distal end, after the cutting step is implemented, wherein the longitudinal innermost wall surface of the dried paper article is an inner curve surface shaped in conformation to a shape of the outer curve surface of the respective corresponding first upright post.

Preferably, each of the first vertical pits further has a longitudinal innermost wall surface which is an inner curve surface formed around the respective corresponding longitudinally-elongated center line and has the maximum first-vertical-pit height, thereby making the dried paper article correspondingly forming a longitudinal outermost wall surface, which is an outer curve surface, located between both the top distal end and the top distal end, after the cutting step is implemented, wherein the outer curve surface of the dried paper article is shaped in conformation to a shape of the inner curve surface of the respective corresponding first vertical pit, and a wall-thickening region constructed of the dried plant fibrous body is formed between both the outer curve surface and the inner curve surface of the dried paper article.

Preferably, after the cutting step is implemented for the dried paper article, the filter tip is formed from the dried paper article, wherein the wall-thickening region is used as a filtration region and has different cross-sectional thicknesses gradually narrowed down, along the respective corresponding longitudinally-elongated center line, from the top distal end to the bottom distal end.

Preferably, after the cutting step is implemented for the dried paper article, the cartridge container is formed from the dried paper article, wherein the wall-thickening region has an identical cross-sectional thickness formed, along the respective corresponding longitudinally-elongated center line, from the top distal end to the bottom distal end.

Preferably, while the dried paper article is the filter tip, the outer curve surface of the longitudinal outermost wall surface of each of the first upright posts is a combination of cascading a smaller outer cylindrical surface, an outer conical-frustum surface and a larger outer cylindrical surface, along the respective corresponding longitudinally-elongated center line.

Preferably, while the dried paper article is the cartridge container, the outer curve surface of the longitudinal outermost wall surface of each of the first upright posts is either of an outer cylindrical surface and an outer conical-frustum surface.

Preferably, each of the first upright posts has a minimum first-upright-post width formed perpendicular to the respective corresponding longitudinally-elongated center line and smaller than the maximum first-upright-post width, and each of the first vertical pits has a minimum first-vertical-pit width formed perpendicular to the respective corresponding longitudinally-elongated center line, thereby making the dried paper article forming the top opening dependent on the minimum first-upright-post width, making the dried paper article forming the bottom opening dependent on the maximum first-upright-post width, and making the top distal end having a minimum transverse width formed dependent on the minimum first-vertical-pit width, after implementing the cutting step.

Preferably, after the cutting step is implemented, the ratio greater than 3.8 is made.

Preferably, after the cutting step is implemented, the maximum transverse width smaller than 8 mm is made.

Preferably, the method for preparing the electronic cigarette cartridge tube further comprises the steps of: after implementing the cutting step for the dried paper article, forming the cartridge container from the dried paper article; and then implementing a perforating step which comprises: perforating through the top distal end of the cartridge container to form at least one venting aperture thereon.

In another preferred embodiment, the present invention provides a method for preparing an electronic cigarette cartridge tube that comprises a filter tip and a cartridge container, and the method for preparing the electronic cigarette cartridge tube comprises:

a step S10 for integrally forming the filter tip, which comprises:

implementing a pulp-dredging and pre-compression step S100 that comprises the steps of: sinking a first male mold within a slurry tank, and only by way of vacuum exhausting, adsorbing a wet plant fibrous body onto and around an entire outer circumferential surface of each of a plurality of spaced-apart first upright posts located on the first male mold; and then making a first female mold and the first male mold both being mutually matched for pre-compressing the wet plant fibrous body between a first female mold and the first male mold, thereby forming a wet paper article, which is constructed of the wet plant fibrous body, located between the first female mold and the first male mold, wherein each of the first upright posts is protruded outside an upper surface of the first male mold, a plurality of spaced-apart first vertical pits are formed inwardly on from a bottom surface of the first female mold, the plurality of first vertical pits respectively correspond to the plurality of first upright posts in a deployed arrangement and sized proportion, and each of the first vertical pits and the respective corresponding first upright post both are mutually matched, commonly along a respective corresponding longitudinally-elongated center line, such that each of the first upright posts has a maximum first-upright-post width formed perpendicular to the respective corresponding longitudinally-elongated center line, a maximum first-upright-post height formed parallel to the respective corresponding longitudinally-elongated center line, and a ratio, greater than one, of the maximum first-upright-post height being relative to the maximum first-upright-post width, and each of the first vertical pits has a maximum first-vertical-pit width formed perpendicular to the respective corresponding longitudinally-elongated center line, a maximum first-vertical-pit formed parallel to the respective corresponding longitudinally-elongated center line, and a ratio, greater than one, of the maximum first-vertical-pit depth being relative to the maximum first-vertical-pit width; and after implementing the pulp-dredging and pre-compression step S100, implementing a thermo-compression forming step S200 which comprises the steps of: positioning the wet paper article into between a second female mold and a second male mold; making the second female mold and the second male mold both being mutually matched for thermally compressing the wet paper article located therebetween; and by the way of vacuum exhausting, exhausting a portion of water vapor and/or moisture contained within the wet paper article, and thereby forming a dried paper article constructed of the dried plant fibrous body, wherein a plurality of spaced-apart second upright posts are disposed, on an upper surface of the second male mold, with the same deployed arrangement and the same sized proportion as used in forming the plurality of first upright posts, and a plurality of spaced-apart second vertical pits are inwardly formed, from a bottom surface of the second female mold, with the same deployed arrangement and the same sized proportion as used in forming the plurality of first vertical pits; and after implementing the thermo-compression forming step S200, implementing a cutting step S300 which comprises: cutting away a superfluous portion from the dried paper article to form the filter tip, wherein the filter tip is further formed with a first top distal end having a first top opening defined thereon, and a first bottom distal opposed to the first top distal end, having a first bottom opening defined thereon and a maximum transverse width formed dependent on the maximum first-vertical-pit width, wherein the filter tip has a maximum longitudinal height formed between both the first top distal end and the first bottom distal end and between both the maximum first-vertical-pit height and the maximum first-upright-post height, and a ratio, greater than one, of the maximum longitudinal height of the filter tip being relative to the maximum transverse width of the filter tip;

a step S20 for integrally forming the cartridge container, which comprises:

implementing the steps S100, S200 and S300 in sequence, to integrally form the cartridge container, wherein the cartridge container is further formed with a second top distal end having a second top opening defined thereon, and a second bottom distal end opposed to the second top distal end, having a second bottom opening defined thereon and a maximum transverse width, wherein the cartridge container has a maximum longitudinal height formed between both the second top distal end and the second bottom distal end, and a ratio, greater than one of the maximum longitudinal height of the cartridge container being relative to the maximum transverse width of the cartridge container; and a perforating step S400 comprising: perforating through the second top distal end of the cartridge container to form at least one venting aperture thereon;

a material-filling step S30 comprising: filling electronic cigarette cartridge material, containing tobacco ingredient, from the second bottom opening into the cartridge container; and an assembling step S40 comprising: making the first bottom distal end of the filter tip being permanently end-to-end jointed to the second bottom distal end of the cartridge container, thereby forming the entire electronic cigarette cartridge tube.

In another preferred embodiment, the present invention provides an electronic cigarette cartridge tube comprises a filter tip and a cartridge container, both of which are respectively made by a pulp-molding fabrication method including using a male mold for absorbing pulp, and then using a male and female mold assembly for compression on the pulp.

The filter tip has a first longitudinal center line, a first top distal end formed with a first top opening, and a first bottom distal end formed with a first bottom opening and opposed to the first top distal end. The first top distal end has a maximum transverse width formed perpendicular to the first longitudinal center line. The filter tip has a maximum longitudinal height formed, between the first top distal end and the first bottom distal end, parallel to the first longitudinal center line, and a ratio, greater than one, of the maximum longitudinal height of the filter tip being relative to the maximum transverse width of the filter tip. The filter tip further has a longitudinal outermost wall surface formed outside thereof and between the first top distal end and the first bottom distal end, a first hollow chamber formed inside the filter tip and respectively intercommunicating between the first top opening and the first bottom opening, a longitudinal innermost wall surface formed on constructing the first hollow chamber, and a filtration region, which is constructed of a dried plant fibrous body and formed between both the longitudinal outermost wall surface and the longitudinal innermost wall surface of the filter tip. The filtration region has different cross-sectional thicknesses gradually narrowed down, along the first longitudinal center line from the first top distal end to the first bottom distal end.

The cartridge container used to store electronic cigarette cartridge material therein, has a second longitudinal center line, a second top distal end formed with a second top opening, and a second bottom distal end formed with a second bottom opening and opposed to the second top distal end, wherein the second top distal end has a maximum transverse width formed perpendicular to the second longitudinal center line, the cartridge container has a maximum longitudinal height formed between both the second top distal end and the second bottom distal end and parallel to the second longitudinal center line, a ratio, greater than one, of the maximum longitudinal height of the cartridge container being relative to the maximum transverse width of the cartridge container, a longitudinal outermost wall surface formed between both the second top distal end and the second bottom distal end, a second hollow chamber respectively intercommunicating with both the second top opening and the second bottom opening, a longitudinal innermost wall surface on constructing the second hollow chamber, and a wall-thickening region constructed of the dried plant fibrous body, having an identical cross-sectional thickness formed, between both the longitudinal outermost wall surface and the longitudinal innermost wall surface of the cartridge container, along the second longitudinal center line from the second top distal end to the second bottom distal end, wherein by collocating the first longitudinal center line and the second longitudinal center line both in collinearity thereof, the second bottom distal end of the filter tip is permanently end-to-end jointed to the second bottom distal end of the cartridge container, and by aligning and interconnecting both the first bottom opening and the second bottom opening, the first hollow chamber and the second hollow chamber both are intercommunicated with each other, to complete an assembling of the entire electronic cigarette cartridge tube.

Preferably, the ratio that the maximum longitudinal height of the cartridge container is relative to the maximum transverse width of the cartridge container is greater than 3.8, and the ratio that the maximum longitudinal height of the filter tip is relative to the maximum transverse width of the filter tip is greater than 3.8.

Preferably, the maximum transverse width of any one of the cartridge container and the filter tip is smaller than 8 mm.

Preferably, the second top distal end of the cartridge container is further formed with at least one venting aperture communicated with the second hollow chamber.

Preferably, the longitudinal innermost wall surface of the filter tip is formed with an inner curve surface which is a combination of cascading a smaller inner cylindrical surface, an inner conical-frustum surface and a larger inner cylindrical surface, along the corresponding first longitudinal center line, and the longitudinal outermost wall surface of the filter tip is formed with an outer curve surface which is either of an outer cylindrical surface and an outer conical-frustum surface.

Preferably, the longitudinal innermost wall surface of the cartridge container is formed with an inner curve surface which is either of an inner cylindrical surface and an inner conical-frustum surface, and the longitudinal outermost wall surface of the cartridge container is formed with an outer curve surface which is either of an outer cylindrical surface and an outer conical-frustum surface.

Consequently, the present invention can effect the following technical benefits that: compared with the prior arts, the electronic cigarette cartridge tube and the method for preparing the same, in accordance with the present invention, can not only resolve the technical problems of the existing pulp-molding fabrication method that is incapable of integrally forming an electronic cigarette cartridge tube components (e.g. a filter tip or a cartridge container) with a ratio, greater than one, of its maximum longitudinal height being relative to its maximum transverse width, but also saves its working cycle time, benefiting its mass production, assuring its higher product yield and quality. Furthermore, the electronic cigarette cartridge tube and the method for preparing the same, in accordance with the present invention, treat pure plant fibers as a material used for constituting the entire electronic cigarette cartridge tube. Therefore, it can achieve a great filtration capacity, a low cost, a better flame retardance (i.e. a lower ignition temperature), a great oil resistance, and a property of easily reducing temperature, wherein the hollow chamber design, constructed with an inner curved-surface, of the electronic cigarette cartridge tube can accomplish several advantages of expediting air ventilation, rapidly reducing temperature, non-occurrence of both healthy doubt and food safety problem for the human body, and conforming with FDA food-grade certification standard, thereby being capable of actually accomplishing the environmental protection requirement for both biodegradability and compostability.

DESCRIPTION OF THE DIAGRAMS

DETAILED DESCRIPTION OF THE PREFERRED EMBODIMENTS

Figure 1:
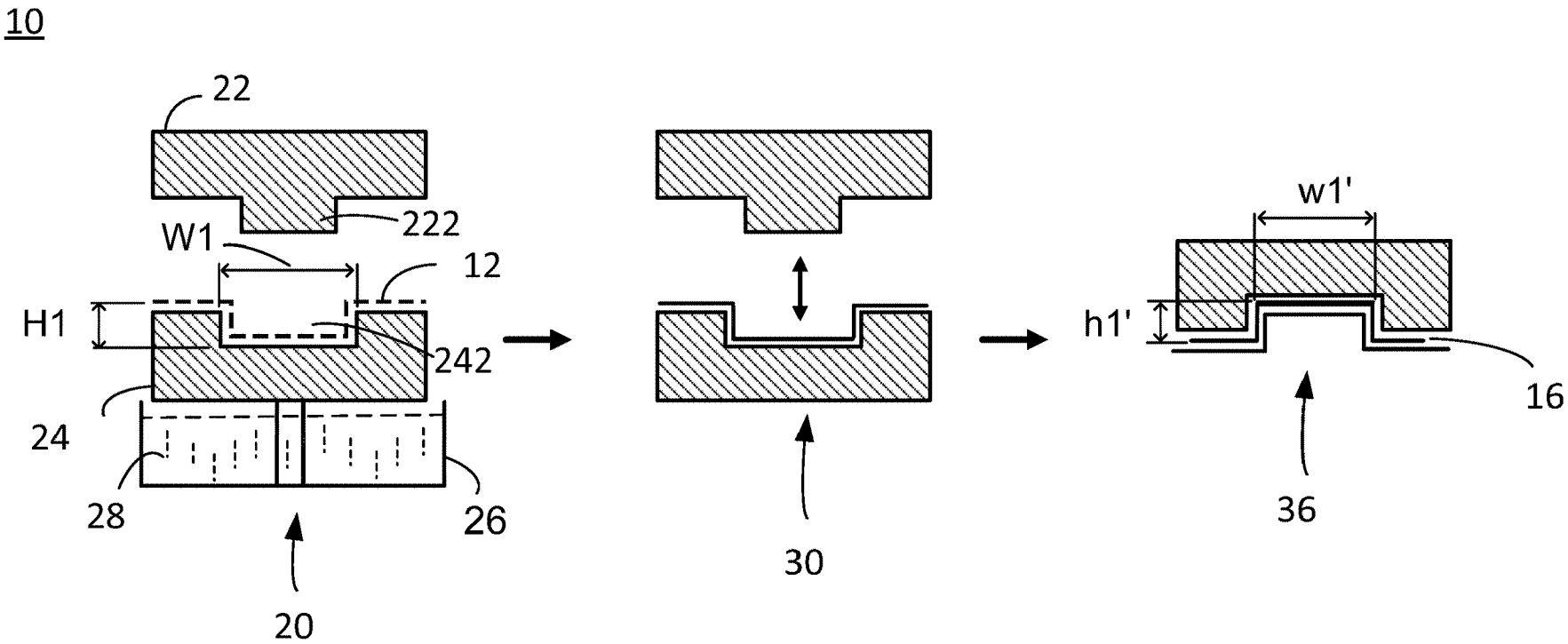
FIG. 1 (Prior Art)
FIG. 1 depicts a schematic diagram of consistent production machines allocated in a production line used with a pulp-molding fabrication method.

The technical proposals in the embodiments of the present invention will be clearly and completely described in the following with reference to the accompanying drawings of the embodiments of the present invention. The directional terms mentioned in the present invention, such as "upper", "lower", "before", "after", "left", "right", "inside", "outside", "side", etc., are merely illustrative the direction of the drawing. Therefore, the directional terminology used is for the purpose of illustration and understanding of the invention, which is not intended to limit the invention.

Figure 2A:
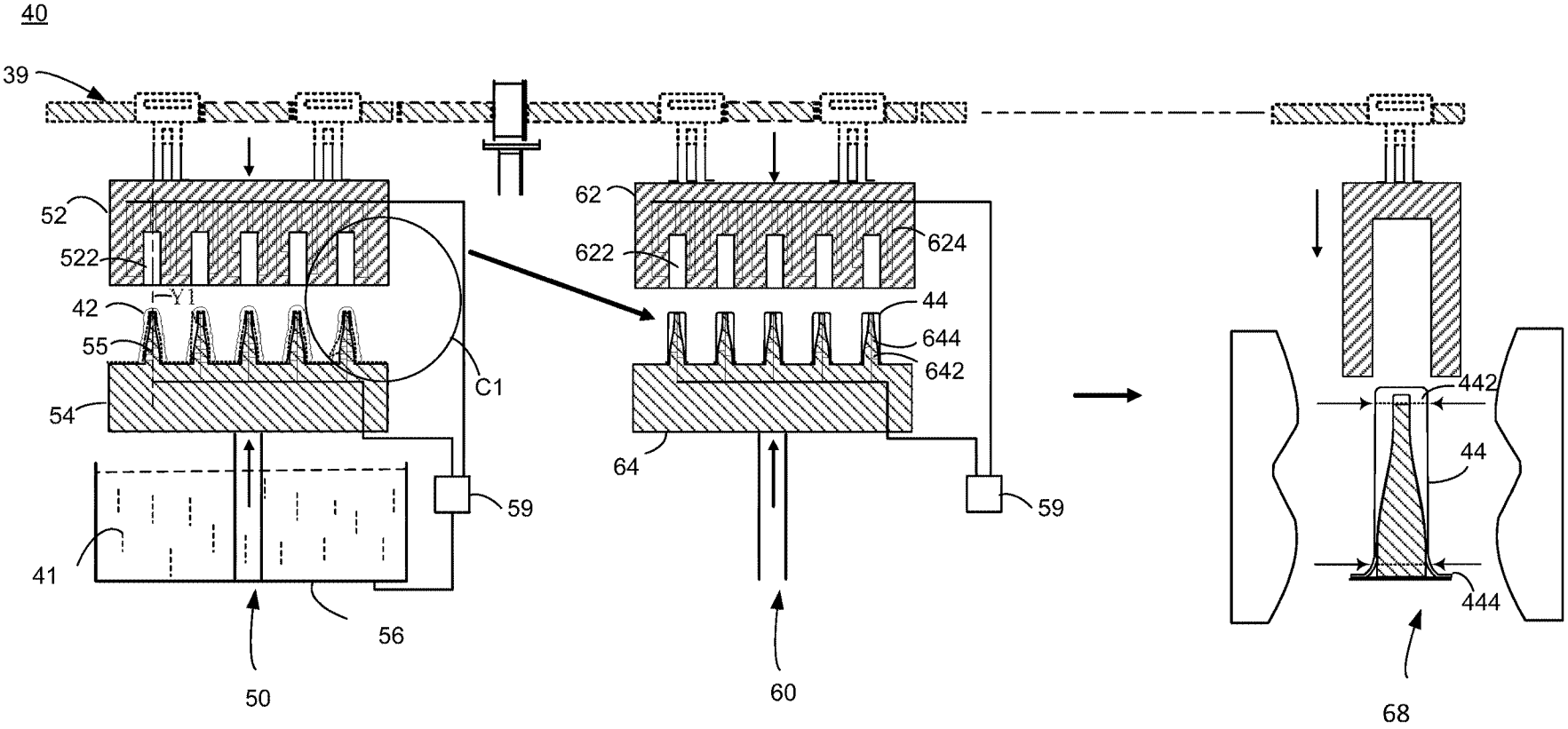
FIG. 2A depicts a schematically cross-sectional diagram of consistent production machines allocated in a pulp-molding production line, according to a first preferred embodiment of the present invention, wherein the pulp-molding production line is configurable to prepare a filter tip of an electronic cigarette cartridge tube.
Figure 2B:
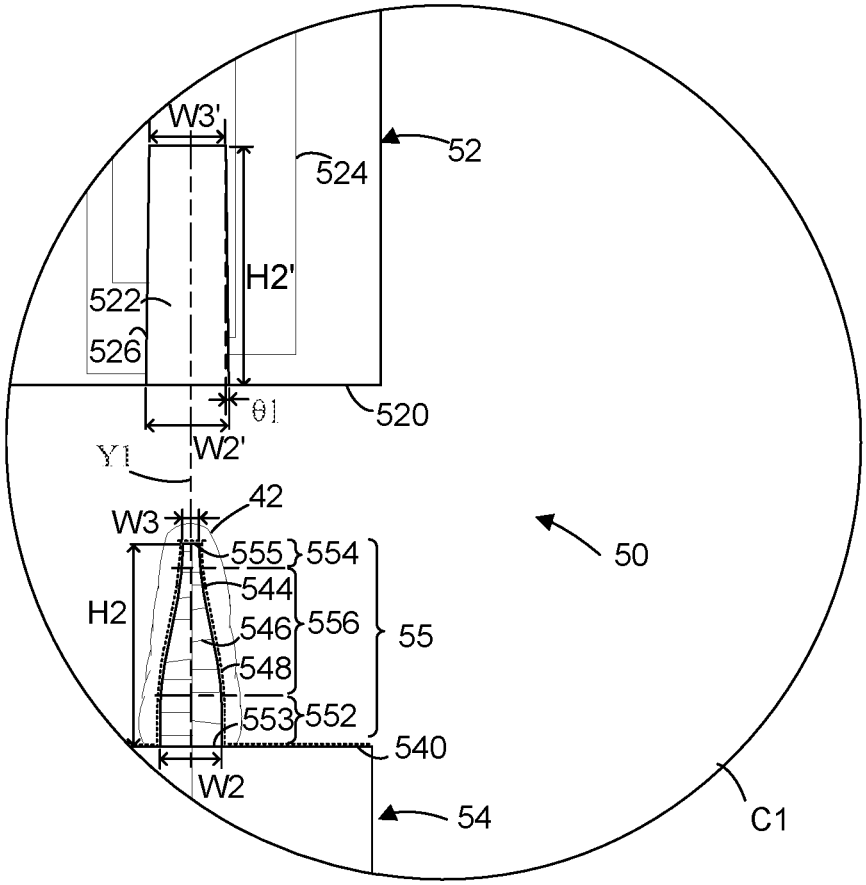
FIG. 2B depicts a partially-enlarged cross-sectional view according to a circled region C1 shown in FIG. 2A.
Figure 3A:
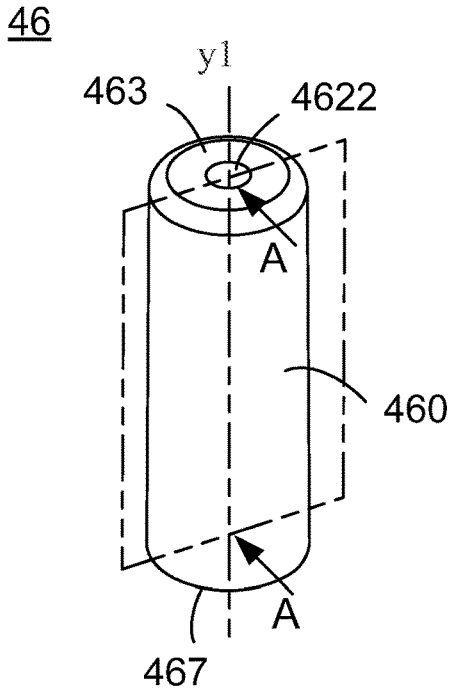
FIG. 3A depicts a perspective diagram of a filter tip of the electronic cigarette cartridge tube, which is prepared by the pulp-molding production line shown in FIG. 2A.

First of all, please refer to the illustrations shown in FIGS. 2A and 2B, wherein FIGS. 2A depicts a schematically cross-sectional diagram of consistent production machines allocated in a pulp-molding production line 40 according to a first preferred embodiment of the present invention, and 2B depicts a partially-enlarged cross-sectional view according to a circled region C1 shown in FIG. 2A. As illustrated in FIGS. 2A and 2B. The pulp-molding production line 40 can be manipulated on massively-and-automatically producing a filter tip 46 (as shown in FIG. 3A) of an electronic cigarette cartridge tube. The consistently-automated production machines allocated in the pulp-molding production line 40 primarily comprises at least one movable apparatus 39, a pulp-dredging and pre-compression apparatus 50, a vacuum exhausting apparatus 59, a thermo-compression forming apparatus 60 and a cutting apparatus 68.

The pulp-dredging and pre-compression apparatus 50 comprises a first female mold 52 located on the upper part thereof, and a first male mold 54 located on the lower part thereof and correspondingly manipulated together with the first female mold 52. In this preferred embodiment, the herein-called 'female mold' is defined as a mold that has an outer molding surface and a cave structure which is caved inwardly from the outer molding surface, and is primarily operable to shape an outer circumferential surface of a paper article; and the herein-called 'male mold' is defined as a mold that has an outer molding surface and a protrusive structure which is protruded outwardly from the outer molding surface, and is primarily operable to shape an inner circumferential surface of a paper article. The first male mold 54 is disposed with a plurality of spaced-apart first upright posts 55 thereon, each of which is protruded outwardly, along a vertical direction from an upper surface 540 (as the outer molding surface) of the first male mold 54, toward the outside of the upper surface 540. The plurality of first upright posts 55 are allocated in a multidimensional-array manner and evenly distributed, with the same spaced intervals thereamong, over the upper surface 540, for facility of massively producing a number of the filter tips 46 (as shown in FIG. 3A) at the same time. The first female mold 52 has a plurality of spaced-apart first vertical pits 522 formed inwardly, with the same spaced intervals thereamong as same as allocated among the plurality of first upright posts 55, from a bottom surface 520 of the first female mold 52 and toward the inside of the bottom surface 520 such that the plurality of first vertical pits 522 have a deployed arrangement and a sized proportion, both of which respectively correspond to and aligned with a deployed arrangement and a sized proportion of the plurality of first upright posts 55. Accordingly, after the pulp-dredging and pre-compression apparatus 50 makes both the first female mold 52 and the first male mold 54 being upwardly-and-downwardly moved to be closed, each of the first vertical pits 522 of the first female mold 52 and the respective corresponding first upright post 55 of the first male mold 54 both can be mutually matched, commonly along a respective corresponding longitudinally-elongated center line Y1. Thus, each of the longitudinally-elongated center lines Y1 can also be named a mutually-matched center line.

Further referring to this first preferred embodiment illustrated in FIGS. 2A and 2B, each of the first upright posts 55 of the first male mold 54 has a free terminal 555 and a junction terminal 553 opposed to the free terminal 555. The junction terminal 553 is connected onto the upper surface 540 of the first male mold 54 and has a maximum first-upright-post width W2 formed perpendicular to the respective corresponding longitudinally-elongated center line Y1. The free terminal 555 has a minimum first-upright-post width W3 formed smaller than the maximum first-upright-post width W2 and perpendicular to the respective corresponding longitudinally-elongated center line Y1. The respective first upright posts 55 further has a longitudinal outermost wall surface 544 formed throughout an entire outermost exterior of the respective first upright post 55 and located between the free terminal 555 and the junction terminal 553. The longitudinal outermost wall surface 544 is rendered as an outer curve surface formed around the respective corresponding longitudinally-elongated center line Y1 and has a maximum first-upright-post height H2 formed parallel to the respective corresponding longitudinally-elongated center line Y1, wherein a ratio R2 that the maximum first-upright-post height H2 is relative to the maximum first-upright-post width W2 is greater than one (i.e. H2/W2=R2, R2>1). The outer curve surface of the longitudinal outermost wall surface 544 is rendered as a quadratic surface. In this preferred embodiment, the outer curve surface is substantially rendered as a combination of cascading a larger outer cylindrical surface 552, an outer conical-frustum surface 556 and a smaller outer cylindrical surface 554, along the respective corresponding longitudinally-elongated center line Y1. This will make the respective first upright post 55 shaped in a three-dimension shape such as a like-bottle longitudinal cylinder. A horizontal cross section of the free terminal 555 is rendered as a round plane that has a diameter same as the minimum first-upright-post width W3, and a horizontal cross section of the junction terminal 553 is rendered as a round plane that has a diameter same as the maximum first-upright-post width W2. Nevertheless, the above description does not therefore limit the outer curve surface of the longitudinal outermost wall surface 544 to be the three-dimension shape as illustrated in FIG. 2A, the longitudinal outermost wall surface 544 can also be designed, on demands, into any other three-dimension shape having a geometrically spatial structure. Further referring to this embodiment illustrated in FIGS. 2A and 2B, a number of micro-pores (not shown) are formed in a manner of being evenly distributed throughout the longitudinal outermost wall surface 544 of the respective first upright posts 55, and are individually liquid-communicated to said vacuum exhausting apparatus 59, via a number of exhausting passages 546 defined inside the first male mold 54 and respectively connected with the number of micro-pores, so as to exhaust moistures and/or their existed inside a pulp (only by way of vacuum exhausting) which is located over the longitudinal outermost wall surface 544 of the respective first upright posts 55. An entire outer circumferential surface (including the longitudinal outermost wall surface 544) formed on both the respective first upright post 55 and the upper surface 540 are sheathed with a layer of metallic screen 548 thereonto.

Correspondingly referring to this preferred embodiment illustrated in FIGS. 2A and 2B, the respective first vertical pit 522 of the first female mold 52 is formed with a bore on the bottom surface 520 and is inwardly extended from the bottom surface 520 to reach a bottom portion. The bore has a maximum first-vertical-pit width W2' formed perpendicular to the respective corresponding longitudinally-elongated center line Y1, and the bottom portion has a minimum first-vertical-pit width W3' formed smaller than the maximum first-vertical-pit width W2' and perpendicular to the respective corresponding longitudinally-elongated center line Y1, thereby making positive draft angles θ 1 formed respectively, with relative to the respective corresponding longitudinally-elongated center line Y1, on two lateral sides of a longitudinal cross section of the respective first vertical pit 522. The respective first vertical pit 522 is constructed with a longitudinal innermost wall surface 526 which is rendered as an inner curve surface formed, around the respective corresponding longitudinally-elongated center line Y1, with a maximum first-vertical-pit depth H2' parallel to the respective corresponding longitudinally-elongated center line Y1, and has a ratio R2', greater than one, of the maximum first-vertical-pit depth H2' being relative to the maximum first-vertical-pit width W2' (i.e. h2'/W2'=R2', R2'>1). In this preferred embodiment, the inner curve surface of the longitudinal innermost wall surface 526 of the respective first vertical pit 522 is substantially rendered as an inner cylindrical surface or a conical-frustum surface (owing to the formation of the positive draft angle θ1), formed along a longitudinal direction thereof. This will make the respective first vertical pit 522 formed, such as a vertically cylindrical pit, along the longitudinal direction. A horizontal cross-section of the bore of the respective first vertical pit 522 is rendered as a round hole having a diameter same as the maximum first-vertical-pit width W2'. A cross-section of the bottom portion is a round plane having a diameter same as the minimum first-vertical-pit width W3'. Nevertheless, the above description does not therefore limit the inner curve surface of the longitudinal innermost wall surface 526 to be the three-dimension shape as illustrated in FIG. 2A, the longitudinal innermost wall surface 526 can also be designed, on demands, into any other three-dimension shape having a geometrically spatial structure. Furthermore, in this embodiment illustrated in FIGS. 2A and 2B, a number of micro-pores (not shown) also are formed in a manner of being evenly distributed throughout an entire inner circumferential surface (namely, the longitudinal innermost wall surface 526) of the respective first vertical pits 522 of the first female mold 52. The number of micro-pores are respectively liquid-communicated to the vacuum exhausting apparatus 59 through a number of exhausting passages 524 formed inside the first female mold 52 and respectively connected with the number of micro-pores, so as to exhaust moistures and/or the air inside a pulp (only by way of vacuum exhausting) which is being located within the respective first vertical pit 522.

As illustrated in FIGS. 2A and 2B, at an initial stage when the pulp-molding production line 40 is manipulated for automated production, the pulp-dredging and pre-compression apparatus 50 makes the first male mold 54 sunk into a slurry tank 56 used for storing a slurry (or called 'pulp') 41 that contains a large amount of wet plant fibrous body; and next, only by way of vacuum exhausting of the vacuum exhausting apparatus 59 via the exhausting passages 546 of the first male mold 54, the pulp 41 constructed of the wet plant fibrous body is formed in a form of layer evenly adsorbed onto the entire metallic screen 548 located over the outer circumferential surface (as the longitudinal outermost wall surface 544) of the plurality of first upright posts 55 of the first male mold 54. Next, the pulp-dredging and pre-compression apparatus 50 makes the first female mold 52 and the first male mold 54 both being respectively upwardly-and-downwardly moved to be mutually matched with each other and further exerts a slight pressure to pre-compress the pulp 41, constructed of wet plant fibrous body, located between the first female mold 52 and the first male mold 54; simultaneously, by the way of the vacuum exhausting apparatus 59 implementing the vacuum exhausting of for the first male and female molds 54, 52, a vacuum environment is established therebetween and a less portion of water vapor and/or moisture contained in the pulp 41 can be exhausted out from the pulp 41, so as to integrally form a wet paper article 42, constructed of the wet plant fibrous body (or called 'wet billet'), between the first female mold 52 and the first male mold 54, after the pre-compressing the pulp 41. In a practical exemplar, a material ingredient of the pulp 41 includes a composition of 70% bamboo pulps and 30% bagasse pulps, such that a solid structure of the wet paper article 42 is fully constructed of the plant fibrous body, thereby achieving the advantages of both the great temperature tolerance and the great oil resistance. In operating on the pulp-dredging and pre-compression, the pulp-dredging and pre-compression apparatus 50 implements the pre-compression under a working pressure range of 60-100 MPa and a working temperature range of 20-30° C., so as to integrally form the entire wet paper article 42 having a moisture content range of 75%-85% therein; nevertheless, the above description does not therefore limit the composition ingredient and the proportion of the wet pulp 41, the working pressure range and a working temperature range of the pulp-dredging and pre-compression apparatus 50, and a moisture content range of the wet paper article 42. This is because depending on different product structures and demands, the composition ingredient and the proportion of the wet pulp 41, the working pressure range and the working temperature range used in the pulp-dredging and pre-compression apparatus 50, and the moisture content range of the wet paper article 42 all might be changed.

Next, as illustrated in FIGS. 2A and 2B, by the vacuum exhausting apparatus 59 vacuum-suctioning the wet paper article 42 onto an underside of the bottom surface 520 of the first female mold 52, the at least one movable apparatus 39 makes the first female mold 52 moved, along with bringing the adsorbed wet paper article 42 together, to reach between both a second female mold 62 and a second male mold 64 of the thermo-compression forming apparatus 60. Next, by relieving the vacuum suction, the first female mold 52 releases the wet paper article 42 thereby positioning the paper article 42 on the second male mold 64 of the thermo-compression forming apparatus 60.

As illustrated in FIGS. 2A and 2B, a longitudinal height and a transverse width of each of molding sides in each of both the second female mold 62 and the second male mold 64 of the thermo-compression forming apparatus 60 has a deployed arrangements and a sized proportion (including size proportions of each of the molds 62, 64) are similar to a deployed arrangement and a sized proportion of the first female mold 52 and the first male mold 54 of the pulp-dredging and pre-compression apparatus 50. For example, an upper surface of the second male mold 64 is disposed with a plurality of spaced-apart second upright posts 642 in the same deployed arrangement and the same sized proportion as used in forming the plurality of first upright posts 55 on the first male mold 54, and a plurality of spaced-apart second vertical pits 622 are inwardly formed, toward the inside of a bottom surface of the second female mold 62, in the same deployed arrangement and the same sized proportion as used in forming the plurality of first vertical pits 522 on the first female mold 52. Briefly speaking, the respective second upright post 642 in this embodiment has a maximum second-upright-post height formed identical to the height H2, a maximum second-upright-post width formed identical to the width W2, and a ratio R2 that the maximum second-upright-post height H2 is relative to the maximum second-upright-post width W2 also is formed greater than one (i.e. h2/W2=R2, R2>1). Similarly, the respective second vertical pit 622 has a maximum second-vertical-pit depth formed identical to the depth H2', a maximum second-vertical-pit width formed identical to the width W2', and a ratio R2' that the maximum second-vertical-pit depth H2' is relative to the maximum second-vertical-pit width W2' also is formed greater than one (i.e. h2'/W2'=R2', R2'>1). Furthermore, an entire inner circumferential surface of the respective second vertical pit 622 of the second female mold 62 and an entire outer circumferential surface of the respective second upright post 642 of the second male mold 64 both also are respectively formed with a number of exhausting passages 624, 644 for liquid-communicating to the vacuum exhausting apparatus 59.

Next, as illustrated in FIG. 2A, the thermo-compression forming apparatus 60 makes the second female mold 62 and the second male mold 64 both being respectively upwardly-and-downwardly moved to be mutually matched with each other, and exerts a higher pressure to thermally compress the wet paper article 42 positioned between the second female mold 62 and the second male mold 64. At the same time, by the way of vacuum exhausting of the vacuum exhausting apparatus 59 used with the thermo-compression forming apparatus 60, a larger portion of water vapor and/or moisture contained in the wet paper article 42 is exhausted out the wet paper article 42 so as to form a dried paper article 44, constructed of the dried plant fibrous body, from the wet paper article 42; nevertheless, the number of compressive-matches is not therefore limited to one-time compressive-match. In a practical exemplar, the thermo-compression forming apparatus 60 implements a thermo-compression under a working pressure range of 60-100 MPa and a working temperature range of 110° C.-150° C. so as to integrally form the dried paper article 44 having a moisture content range of 2.5%-5%; nevertheless, the above description does not therefore limit the working pressure range, the working temperature range and the moisture content range. This is because depending on different product structures and demands, the working pressure range and the working temperature range used in the thermo-compression forming apparatus 60, and the moisture content range of the dried paper article 44 all might be changed.

As illustrated in FIG. 2A, the cutting apparatus 68 is operable to cut away a superfluous portion 442, 444 respectively from both of a top end and a lower end of the dried paper article 44, thereby forming a filter tip 46 (shown in FIGS. 3A and 3B, and detailed later) constructed of absolutely-dried plant fibrous body. In this embodiment, the cutting apparatus 68 is an existing duplicating-to-cut circumferential cutting machine having cutting molds, or any other kind of cutting apparatus.

As illustrated in FIG. 2A, the at least one movable apparatus 39 may include several independently-operating movable sub-apparatuses, or a single moving system which integrates a variety of current activated components functioned in driving or conveying molds. The current activated components, for example, including a combination of a number of or motor-driven mechanical arms, a leadscrew rod, a ball screw rod assembly, controllers/MCU, air-pressure/hydraulic cylinders and related pumps and so on, so as to drive or convey the respective male molds 52, 62 among the pulp-dredging and pre-compression apparatus 50, the thermo-compression forming apparatus 60 and the cutting apparatus 68. In other different embodiment, the at least one movable apparatus 39 can also be accomplished by combination between existing slide rails and corresponding slidable seats to implement relative slide movements. The at least one movable apparatus 39 can also be designed with driving structures to implement different directional movements, depending on actual demands, including a horizontal movement, a vertical movement or a three-dimensional spatial movement. Since the above-described activated components belong to the prior arts, their relevant details will be omitted hereinafter. Besides, the at least one movable apparatus 39 can also accept a programmable control from a programmable controller unit (not shown) to synchronously launch several tasks, including conveying the respective male molds 52, 62, among the pulp-dredging and pre-compression apparatus 50, the thermo-compression forming apparatus 60 and the cutting apparatus 68.

Figure 2C:
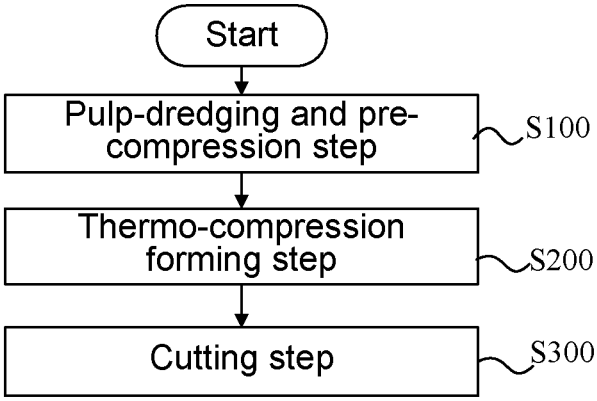
FIG. 2C depicts a flowchart of a method for preparing the electronic cigarette cartridge tube, according to the pulp-molding production line shown in FIG. 2A.

Further referring to FIGS. 2A~2C, FIG. 2C depicts a flowchart of a method for preparing an electronic cigarette cartridge tube, according to the pulp-molding production line 40 shown in FIG. 2A. Since concerning the operations of consistent production machines allocated in the pulp-molding production line 40 as illustrated in FIG. 2A, the respective component structures and their related component functions, used in the method for preparing the electronic cigarette cartridge tube, all can refer to the respective embodiments afore introduced and shown in FIGS. 2A and 2B, and will be omitted hereinafter. As illustrated in FIG. 2C, the method for preparing the electronic cigarette cartridge tube comprises the following primary steps operable for massively-and-automatically producing the filter tip 46 (as shown in FIG. 3A):

Implementing a pulp-dredging and pre-compression step S100 that comprises the steps of: by using a pulp-dredging and pre-compression apparatus 50, making a first male mold 54 sunk into a slurry tank 56 used for storing a slurry (or called 'pulp') 41 that contains a large amount of wet plant fibrous body; and next, only by way of vacuum exhausting of the exhausting passages 546 for the first male mold 54, forming the pulp 41, constructed of the wet plant fibrous body, in a form of a layer evenly adsorbed onto the metallic screen 548 of the entire outer circumferential surface of each of a plurality of spaced-apart first upright post 55 of the first male mold 54; and then making the first male mold 54 being mutually matched with a first female mold 52, for pre-compressing the pulp 41, constructed of the wet plant fibrous body, positioned between the molds 52, 54, thereby integrally forming a wet paper article (or called 'wet billet') 42, constructed of the wet plant fibrous body 42, between the first female mold 52 and the first male mold 54, wherein the respective first upright posts 55 are outwardly protruded from the upper surface 540 of the first male mold 54 such that the respective first upright post 55 has a free terminal 555 and an junction terminal 553 opposite to the free terminal 555 and connected to the upper surface 540 of the first male mold 54. A plurality of spaced-apart first vertical pits 522 are inwardly formed on from a bottom surface 520 of the first female mold 52 such that the respective first vertical pit 522 has a bore formed on the bottom surface 520 and is inwardly longitudinally extended from the bore to reach a bottom portion thereof. The plurality of first vertical pits 522 have a deployed arrangement and a sized proportion both respectively corresponding to a deployed arrangement and a sized proportion of the plurality of first upright posts 55 of the first male mold 54. Each of the first vertical pits 522 and the respective corresponding first upright post 55 both can be mutually matched, commonly along a respective corresponding longitudinally-elongated center line Y1. The junction terminal 553 has a maximum first-upright-post width W2 formed perpendicular to the respective corresponding longitudinally-elongated center line Y1. The free terminal 555 has a minimum first-upright-post width W3 formed perpendicular to the respective corresponding longitudinally-elongated center line Y1 and smaller than the maximum first-upright-post width W2. The respective first upright post 55 further has a longitudinal outermost wall surface 544 formed on between the free terminal 555 and the junction terminal 553. The longitudinal outermost wall surface 544 is an outer curve surface formed around the respective corresponding longitudinally-elongated center line Y1, and has a maximum first-upright-post height H2 formed parallel to the respective corresponding longitudinally-elongated center line Y1, and a ratio R2, greater than one, of the maximum first-upright-post height H2 being relative to the maximum first-upright-post width W2 (i.e. h2/W2=R2, R2>1). Preferably, the outer curve surface of the longitudinal outermost wall surface 544 of the respective first upright posts 55 is a combination of substantially cascading a smaller outer cylindrical surface 554, an outer conical-frustum surface 556 and a larger outer cylindrical surface 552, along the respective corresponding longitudinally-elongated center line Y1. In the respective first vertical pits 522 of the first female mold 52, the bore thereof has a maximum first-vertical-pit width W2' formed perpendicular to the respective corresponding longitudinally-elongated center line Y1, and the bottom thereof has a minimum first-vertical-pit width W3' formed perpendicular to the respective corresponding longitudinally-elongated center line Y1 and smaller than the maximum first-vertical-pit width W2'. The respective first vertical pit 522 has a longitudinal innermost wall surface 526 rendered as an inner curve surface formed around the respective corresponding longitudinally-elongated center line Y1 (e.g. a conical-frustum surface having a positive draft angle θ1), a maximum first-vertical-pit depth H2' formed parallel to the respective corresponding longitudinally-elongated center line Y1, and a ratio R2', greater than one, of the maximum first-vertical-pit depth H2' being relative to the maximum first-vertical-pit width W2' (i.e. h2'/W2'=R2', R2'>1). In a practical exemplar, the material ingredient of the wet pulp 41 includes a composition of 70% bamboo pulps and 30% bagasse pulps, such that a solid structure of the wet paper article 42 is fully constructed of the plant fibrous body, thereby achieving the advantages of both great temperature tolerance and great oil resistance;

after implementing the pulp-dredging and pre-compression step S100, next implementing a thermo-compression forming step S200 (as illustrated in FIGS. 2A and 2B) comprising: by cooperation of the at least one movable apparatus 60 with the vacuum exhausting apparatus 59, moving the second male mold 54 along with bringing the wet paper article 42 together, thereby positioning the wet paper article 42 between the second female mold 62 and the second male mold 64 of thermo-compression forming apparatus 60; and then, the thermo-compression forming apparatus 60 making the second female mold 62 and the second male mold 64 both being mutually matched with each other, and exerting a larger pressure to thermally compress the wet paper article 42 between the two molds 62, 64; and at the same time, by the way of the vacuum exhausting apparatus 59 implementing the vacuum exhausting for two molds 62, 64, exhausting a larger amount of water vapor and/or moisture out from the wet paper article 42, thereby forming a dried paper article 44, constructed of the dried plant fibrous body, from the wet paper article 42, wherein the upper surface of the second male mold 64 is disposed with a plurality of spaced-apart second upright posts 642 in the same deployed arrangement and the same sized proportion both as disposing the plurality of first upright posts 55 on the first male mold 54, the bottom surface of the second female mold 62 has a plurality of spaced-apart second vertical pits 622 inwardly formed, toward the inside of the second female mold 62, in the same deployed arrangement and the same sized proportion both as forming the plurality of first vertical pits 522 on the first female mold 52. Briefly speaking, in this embodiment, the respective second upright posts 642 has a ratio R2, greater than one, of the maximum second-upright-post height H2 being relative to the maximum second-upright-post width W2, is (i.e. h2/W2=R2, R2>1), and the respective second vertical pit 622 has a ratio R2', greater than one, of the maximum second-vertical-pit depth H2' being relative to the maximum second-vertical-pit width W2' (i.e. h2'/W2'=R2', R2'>1). In a practical exemplar of implementing the thermo-compression forming step S200, thermally compressing the wet paper article 42 is implemented under a working pressure range of 60-100 MPa and a working temperature range of 110° C.-150° C. so as to integrally form the dried paper article 44 having a moisture content range of 2.5%-5% therein; nevertheless, the above-description does not therefore limit the working pressure range and the working temperature range both for thermally compression, and the moisture content range of the dried paper article 44. This is because depending on different product structures and demands, the working pressure range and the working temperature range both and a moisture content range of the dried paper article 44, rendered in the thermo-compression forming step S200, all might be changed; and after implementing the thermo-compression forming step S200, next implementing a cutting step S300 comprising that: as illustrated in FIG. 2A, by a cutting apparatus 68, cutting away a few superfluous portions 442, 444 from both of an top end and a lower end of the dried paper article 44; and after implementing the cutting step S300, forming the filter tip 46 constructed of an absolutely-dried plant fibrous body (as shown in FIGS. 3A and 3B, and detailed later); in this embodiment, the cutting apparatus 68 may be an existing duplicating-to-cut circumferential cutting machine or any other kind of cutting apparatus.

Figure 3B:
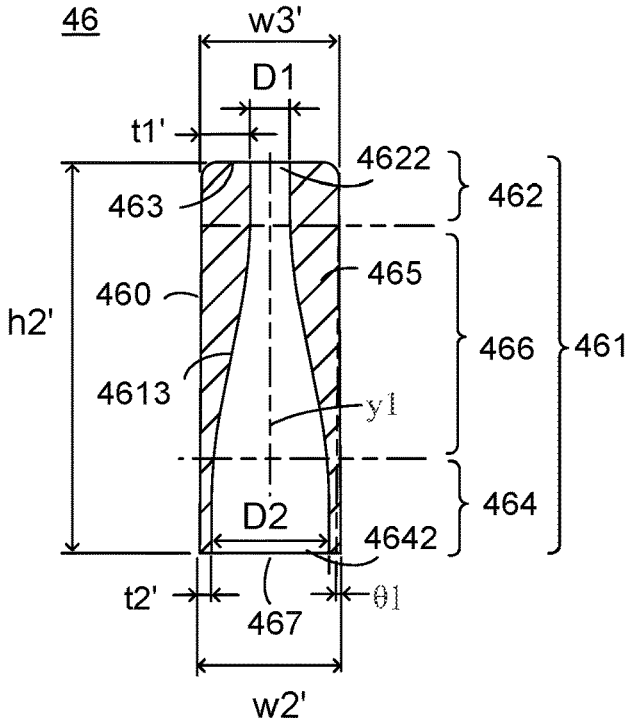
FIG. 3B depicts a laterally cross-sectional view taken along a sectioning plane A-A of the filter tip shown in FIG. 3A.

Further referring to FIGS. 2A, 2C and 3A-3B, FIG. 3A depicts a perspective diagram of the filter tip 46 of the electronic cigarette cartridge tube, which is integrally formed by a preparation according to the pulp-molding production line 40 shown in FIGS. 2A, and 3B depicts a laterally cross-sectional view taken along a sectioning plane A-A of according to the filter tip 46 shown in FIG. 3A. After the cutting step 300 illustrated in FIG. 2C is implemented, cutting away the superfluous portions 442, 444 (as shown in FIG. 2A) out from the dried paper article 44 will cause the filter tip 46 formed in an integral structure, as illustrated in FIGS. 3A and 3B, such that the filter tip 46 is further formed with a first longitudinal center line y1 parallel to the respective corresponding longitudinally-elongated center line Y1, a top distal end 463 perpendicular to the first longitudinal center line y1, a top opening 4622 formed on the top distal end 463, a bottom distal end 467 opposed to the top distal end 463 and perpendicular to the first longitudinal center line y1, a bottom opening 4642 formed on the bottom distal end 467, and a longitudinal outermost wall surface 460 located between the top distal end 463 and the bottom distal end 467. Further referring to of the filter tip 46 illustrated in FIGS. 2B and 3B, the bottom distal end 467 has a maximum transverse width w2' formed dependent on the maximum first-vertical-pit width W2' (namely, W2'=w2'), and the top distal end 463 has a minimum transverse width w3' formed dependent on the minimum first-vertical-pit width W3' (namely, W3'=w3'), thereby making the longitudinal outermost wall surface 460 of the filter tip 46 being formed with a positive draft angle θ1 (as corresponding to the positive draft angle θ1 of the respective corresponding first vertical pits 522), and making an exterior shape of the filter tip 46 being formed, like a conical frustum, where the top opening 462 has a diameter D1 formed dependent on the minimum first-upright-post width W3, and the bottom opening 4642 has a diameter D2 formed dependent on the maximum first-upright-post width W2 and greater than the diameter D1; nevertheless, the filter tip 46 according to the present invention may be molded, depending on the demands, to selectively form a variety of a three-dimension solid structures, such as a cubic shape, a triangular shape, a rectangular shape, a trapezoidal shape, a cone shape, a cylindrical shape, a scalene or an asymmetrical geometrical solid and so on, but does not therefore limit the claim scope of protection requested by the present invention. Furthermore, the longitudinal outermost wall surface 460 located between the top distal end 463 and the bottom distal end 467 both of the filter tip 46 has a maximum longitudinal height h2' formed between the maximum first-vertical-pit height H2' and the maximum first-upright-post height H2, wherein a ratio r2 that the maximum longitudinal height h2' is relative to the maximum transverse width w2' is greater than one (i.e. h2'/w2'=r2, r2>1). In another preferred embodiment, the ratio r2 that the maximum longitudinal height h2' is relative to the maximum transverse width w2' is greater than 1.3 (i.e. h2'/w2'=r2, r2>1.3). In another preferred embodiment, the ratio r2 that the maximum longitudinal height h2' is relative to the maximum transverse width w2' is greater than 3.8 (i.e. h2'/w2'=r2, r2>3.8). In another preferred embodiment, the maximum transverse width w2' is smaller than 8 mm. Furthermore, as illustrated in FIGS. 2B and 3B, between both the top distal end 463 and the bottom distal end 467 and inside the filter tip 46, a hollow chamber 461 is further formed with correspondingly to the longitudinal outermost wall surface 544 of the respective corresponding first upright post 55 and is constructed by a longitudinal innermost wall surface 4613. Substantially, the longitudinal innermost wall surface 4613 is rendered as an inner quadratic surface which is progressively narrowed toward the inside thereof, and is formed in conformation to a shape of the outer curve surface of the respective corresponding first upright post 55. The hollow chamber 461 further respectively upwardly-and-downwardly intercommunicates between both of the top opening 4622 and the bottom opening 4642, especially in the top distal end 463 having a place, in which the top opening 4622 is located. Such a design that the diameter D1 of the top opening 4622 is smaller than the diameter D2 of the bottom opening 4642, can make an inner shape of the hollow chamber 461 being shaped, like an air-flowing nozzle, for using as an air-flowing passage (or called 'flue') to expedite air ventilation, thereby being capable of accomplishing an objective of rapidly reducing temperature. Preferably, the inner curve surface of the longitudinal innermost wall surface 4613 of the filter tip 46 is a combination of cascading a smaller inner cylindrical surface 462, an inner conical-frustum surface 466 and a larger inner cylindrical surface 464, along the respective corresponding first longitudinal center line y1; nevertheless, this does not therefore limit what is shaped in the inner curve surface of the longitudinal innermost wall surface 4613 of the filter tip 46. That is because any other shape, with an inner curve surface, capable of accomplishing the objectives of raising their ventilation and reducing temperature, can also be adopted. Similarly, as illustrated in FIGS. 2B and 3B, the longitudinal outermost wall surface 460 of the filter tip 46 is rendered as an outer curve surface which is shaped, e.g. an outer conical-frustum surface or a like-cylinder surface, in conformation to both of a shape and a size of the inner curve surface of the respective corresponding first vertical pit 522; nevertheless, this does not therefore limit what is shaped in the outer curve surface of the longitudinal outermost wall surface 460 of the filter tip 46. Any other outer curve surface shape, with facilities of preparation and usage, can also be adopted.

As illustrated in FIG. 3B, a wall-thickening region 465 that is constructed of an absolutely-dried plant fibrous body is formed between both the outer curve surface of the longitudinal outermost wall surface 460 and the inner curve surface of the longitudinal innermost wall surface 4613, in the filter tip 46. The wall-thickening region 465 is substantially used as a filtration region which has different cross-sectional thicknesses gradually narrowed down, along the respective corresponding first longitudinal center line y1 from the top distal end 463 to the bottom distal end 467. For example, a cross-sectional thickness t1' allocated at the wall-thickening region 465 of the top distal end 463 is smaller than a cross-sectional thickness t2' allocated at the wall-thickening region 465 of the top distal end 467. The filtration region 465 (as the wall-thickening region 465) constructed of the absolutely-dried plant fibrous body has the following advantages of a great filtration capacity, a lower cost, a better flame retardance (i.e. a lower ignition temperature), a great oil resistance, non-occurrence of both healthy doubt and food safety problem for the human body, and conforming with FDA food-grade certification standard, thereby actually accomplishing the environmental protection requirement for both biodegradability and compostability.

Figure 4A:
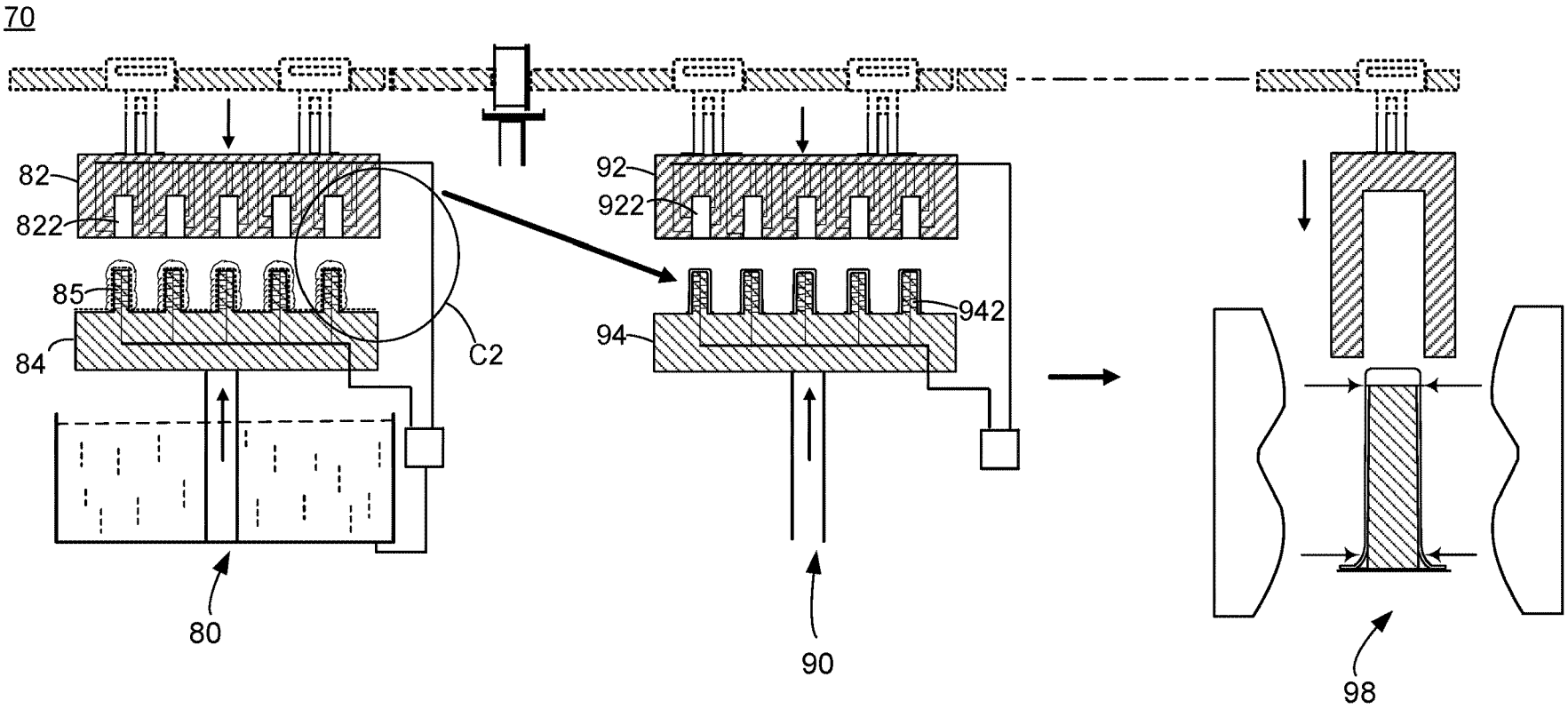
FIG. 4A depicts another schematically cross-sectional diagram of consistent production machines allocated in a pulp-molding production line, according to a second preferred embodiment of the present invention, wherein the pulp-molding production line is configurable to prepare a cartridge container of the electronic cigarette cartridge tube.
Figure 4B:
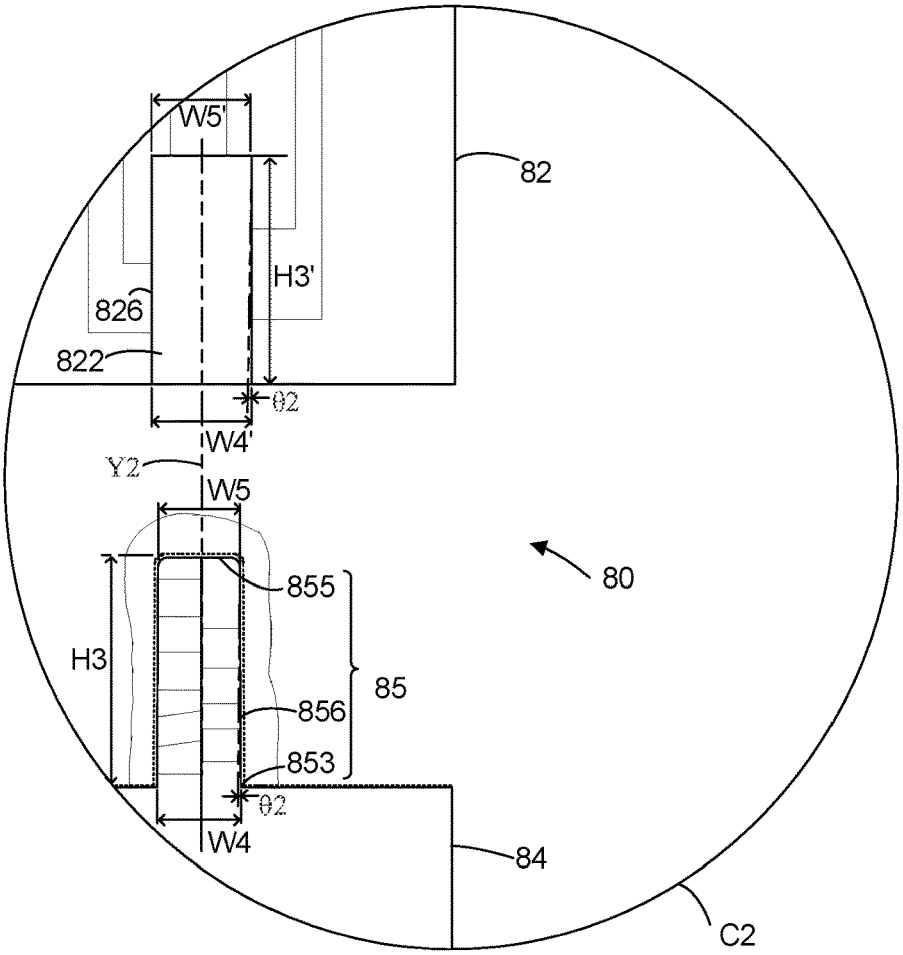
FIG. 4B depicts a partially-enlarged cross-sectional view according to a circled region C2 shown in FIG. 4A.
Figure 5A:
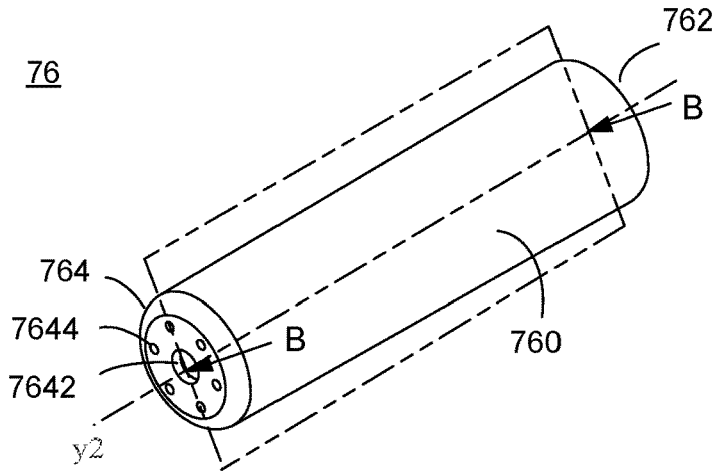
FIG. 5A depicts a perspective diagram of the cartridge container of the electronic cigarette cartridge tube, which is prepared by the pulp-molding production line shown in FIG. 4A.
Figure 5B:
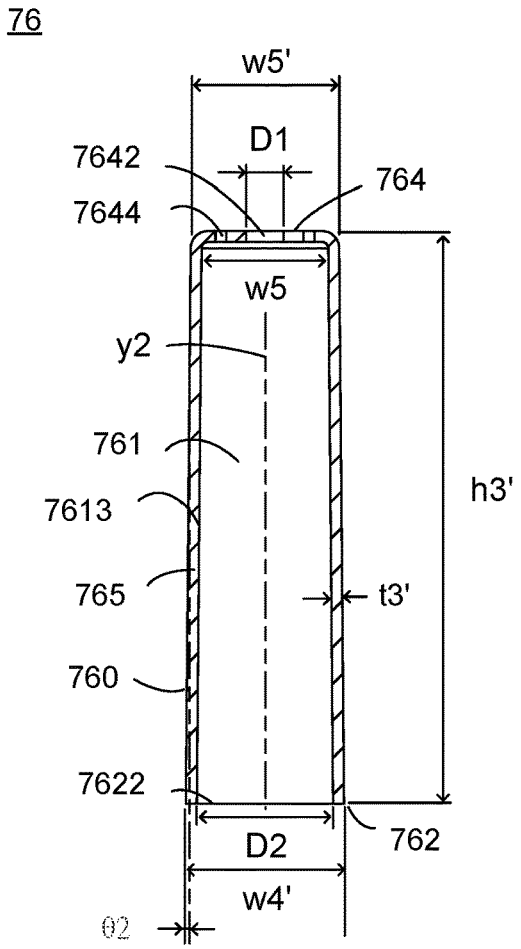
FIG. 5B depicts a laterally cross-sectional view taken along a sectioning plane B-B of the cartridge container shown in FIG. 5A.

Further referring to FIGS. 4A and 4B, FIG. 4A depicts a schematically cross-sectional diagram of consistent production machines of a pulp-molding production line 70 according to a second preferred embodiment of the present invention, and FIG. 4B depicts a partially-enlarged cross-sectional view according to a circled region C2 shown in FIG. 4A. As illustrated in FIGS. 4A and 4B, the pulp-molding production line 70 can be manipulated on massively-and-automatically producing a cartridge container 76 (as shown in FIG. 5A) of the electronic cigarette cartridge tube. It should be noted that: the pulp-molding production line 70 in the second preferred embodiment can adopt the same pulp-molding fabrication method as used in the pulp-molding production line 40 (as illustrated in FIGS. 2A-2C), and therefore does not need to adopt different other fabrication method. Compared with the pulp-molding production line 40 of the first preferred embodiment illustrated in FIGS. 2A-2B, the pulp-molding production line 70 in the second preferred embodiment has the following differences that: a first male mold 84 of a pulp-dredging and pre-compression apparatus 80 is modified to be disposed with a plurality of first upright posts 85 thereon (i.e. an outer curve surface of the longitudinal outermost wall surface 856 of the respective first upright post 85 is an outer cylindrical surface or outer conical-frustum surface) each having a cylinder shape or an outer conical-frustum shape, wherein each of the first upright posts 85 has a free terminal 855 and an junction terminal 853 opposite to the free terminal 85, and a first female mold 82 of a pulp-dredging and pre-compression apparatus 80 is modified to be disposed with a plurality of first vertical pits 822 each having a deeper longitudinal depth. The plurality of first vertical pits 82 and the plurality of first upright posts 85 both are mutually matched with each other, commonly along a respective corresponding longitudinally-elongated center line Y2. The respective first vertical pit 822 has a bore and is inwardly extended from the bore to form a bottom portion. The junction terminal 853 of the respective first upright post 85 is connected to an upper surface of the first male mold 84 and has a maximum first-upright-post width W4 formed perpendicular to the respective corresponding longitudinally-elongated center line Y2. The free terminal 855 has a minimum first-upright-post width W5 formed perpendicular to the respective corresponding longitudinally-elongated center line Y2 and smaller than the maximum first-upright-post width W4. The respective first upright post 85 further has a longitudinal outermost wall surface 856, such as an outer curve surface, formed around the respective corresponding longitudinally-elongated center line Y2 and located on between both the free terminal 855 and the junction terminal 853, a maximum first-upright-post height H3 formed parallel to the respective corresponding longitudinally-elongated center line Y2, and a positive draft angle θ2 with relative to the respective corresponding longitudinally-elongated center line Y2. Preferably, the outer curve surface of the longitudinal outermost wall surface 856 of the respective first upright post 85 is either of an outer cylindrical surface and an outer conical-frustum surface. In the respective first vertical pits 822, the bore has a maximum first-vertical-pit width W4' formed perpendicular to the respective corresponding longitudinally-elongated center line Y2 and the bottom portion has a minimum first-vertical-pit width W5' formed perpendicular to the respective corresponding longitudinally-elongated center line Y2 and smaller than the maximum first-vertical-pit width W4'. The respective first vertical pit 822 further has a longitudinal innermost wall surface 826 that is rendered as an inner curve surface formed around the respective corresponding longitudinally-elongated center line Y2, and has a maximum first-vertical-pit height H3' formed parallel to the respective corresponding longitudinally-elongated center line Y2 and a positive draft angle θ2 with relative to the respective corresponding longitudinally-elongated center line Y2. Preferably, the inner curve surface of the longitudinal innermost wall surface 826 of the respective first vertical pit 822 is either of an inner cylindrical surface and an inner conical-frustum surface, in conformation to the shape of the outer curve surface of the longitudinal outermost wall surface 856 of the respective corresponding first upright post 85. Similarly, a second male mold 94 in the thermo-compression forming apparatus 90 is modified to be disposed with a plurality of second upright posts 942 each having a cylinder shape or an outer conical-frustum shape. The second upright posts 942 have the same deployed arrangement and the same sized proportion both as used in forming the number of the first upright posts 85. Also, a second female mold 92 is modified to be disposed with a plurality of second vertical pits 922 each having a deeper longitudinal depth. The plurality of second vertical pits 922 has the same deployed arrangement and the same sized proportion both as used in forming the number of second vertical pits 822. The other assembles and their functions in the pulp-molding production line 70 all can refer to the above illustrations shown in FIGS. 2A-2C, as same as method step used with the pulp-molding production line 40 of the first preferred embodiment, including using the same plant fibrous body to construct the cartridge container 76 (as shown in FIG. 5A). Thus, its re-descriptions will be omitted hereinafter; Briefly speaking, the present invention merely is modified to be disposed with the respective first upright posts 85, the respective corresponding first vertical pits 822, the respective corresponding second upright post 942 and the respective corresponding second vertical pit 922, which have different curve surfaces shape and different dimensions than used in the first embodiment; namely, such a modification can replace the pulp-molding production line 40 (as illustrated in FIGS. 2A and 3B) operable for integrally forming the filter tip 46, with the pulp-molding production line 70 (as illustrated in FIGS. 4A and 5B) operable for integrally forming the cartridge container 76. Thus, this can save a large amount of hardware cost, laboring cost and machining time.

Figure 4C:
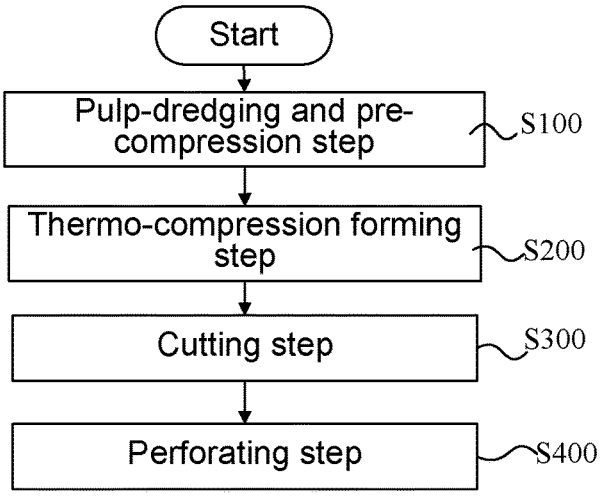
FIG. 4C depicts a flowchart of a method for preparing the electronic cigarette cartridge tube, according to the pulp-molding production line shown in FIG. 4A.

Further referring to FIGS. 4A~4C, FIG. 4C depicts a flowchart of a method for preparing the electronic cigarette cartridge tube, in accordance with the pulp-molding production line shown in FIG. 4A. Since the method for preparing the electronic cigarette cartridge tube as illustrated in FIG. 4A is used with consistent production machines of the pulp-molding production line 70 in the second embodiment, a variety of component structures and their components functions used in the method for preparing the electronic cigarette cartridge tube all can refer to the above-introduced embodiments illustrated in FIGS. 2A-2C and 4A-4B. Those re-descriptions will be omitted hereinafter. As illustrated in FIG. 4C, the method for preparing the electronic cigarette cartridge tube comprises the following primary steps operable for massively-and-automatically producing the cartridge container 76 (as shown in FIG. 5A). The following primary steps comprises:

implementing the pulp-dredging and pre-compression step S100, the thermo-compression forming step S200 and the cutting step S300 in sequence (as illustrated in FIG. 2C);

by implementing the cutting step S300, forming a cartridge container 76 constructed of an absolutely-dried plant fibrous body (as referring to FIGS. 5A and 5B, and detailed later); and implementing a perforating step S400 which comprises: perforating through a top distal end 764 of the cartridge container 76 (as referring to FIG. 5B), to form at least one venting aperture 7644 thereon.

Further referring to FIGS. 4A-4B and 5A-5B, FIG. 5A depicts a perspective diagram of the cartridge container 76 which is integrally formed by a preparation according to the pulp-molding production line 70 shown in FIGS. 4A, and 5B depicts a laterally cross-sectional view taken along a sectioning plane B-B of the cartridge container 76 shown in FIG. 5A. After implementing the cutting step 300 (see FIG. 4C), an integral structure of the cartridge container 76 is formed as illustrated in FIGS. 5A and 5B, wherein the cartridge container 76 is further formed with a second longitudinal center line y2 parallel to the respective corresponding longitudinally-elongated center line Y2, a top distal end 764 formed perpendicular to the second longitudinal center line y2, a top opening 7642 formed on the top distal end 764, a bottom distal end 762 formed opposed to the top distal end 764 and perpendicular to the second longitudinal center line y2, a bottom opening 7622 formed on the bottom distal end 762, and a longitudinal outermost wall surface 760 located between both the top distal end 764 and the bottom distal end 762. Please further refer to FIGS. 4B and 5B. In the cartridge container 76, the bottom distal end 762 has a maximum transverse width w4' formed dependent on a maximum first-vertical-pit width W4' (namely, W4'=w4'), the top distal end 764 has a minimum transverse width w5' (namely, W5'=w5') formed dependent on the minimum first-vertical-pit width W5', thereby making the longitudinal outermost wall surface 760 of the cartridge container 76 being formed with a positive draft angle θ2 (which corresponds to the positive draft angle θ2 of the respective first vertical pits 822), and making an exterior shape of the cartridge container 76 being formed in a conical frustum or a cylinder shape. In the cartridge container 76, a diameter D1 of the top opening 7642 is formed by the perforating step S400, and a diameter D2 of the bottom opening 7622 is formed dependent on the maximum first-upright-post width W4 and is greater than the diameter D1 of the top opening 7642; nevertheless, according to the present invention, the exterior shape of the cartridge container 76 may be molded, depending on the demands, to form a variety of a three-dimension solid structures, such as a cubic shape, a triangular shape, a rectangular shape, a trapezoidal shape, a cone shape, a cylindrical shape, a scalene or an asymmetrical geometrically-structured object and so on, but does not therefore limit the claim scope of protection requested by the present invention. Furthermore, the cartridge container 76 has a maximum longitudinal height h3' formed, from the top distal end 764 to the bottom distal end 762, dependent on between the maximum first-vertical-pit height H3' and the maximum first-upright-post height H3, and a ratio r4, greater than one, of the maximum longitudinal height h3' being relative to the maximum transverse width w4' (i.e. h3'/w4'=r3, r3>1). In another preferred embodiment, the ratio r3 that the maximum longitudinal height h3' is relative to the maximum transverse width w4' is greater than 1.3 (i.e. h3'/w4'=r3, r3>1.3). In another preferred embodiment, the ratio r3 that the maximum longitudinal height h3' is relative to the maximum transverse width w4' is greater than 3.8 (i.e. h3'/w4'=r3, r3>3.8). In another preferred embodiment, the maximum transverse width w4' is smaller than 8 mm. Furthermore, as illustrated in FIGS. 4B and 5B, in the cartridge container 76, a hollow chamber 761 is further formed, between both the top distal end 764 and the bottom distal end 762, correspondingly to the longitudinal outermost wall surface 856 of the respective corresponding first upright post 85, and is constructed by a longitudinal innermost wall surface 7613. The longitudinal innermost wall surface 7613 is substantially rendered as an inner quadratic surface and is shaped in conformation to the shape of the outer curve surface of the longitudinal outermost wall surface 856 of the respective corresponding first upright post 85. Preferably, the inner curve surface of the longitudinal innermost wall surface 7613 of the hollow chamber 761 is rendered as an inner conical-frustum surface or an inner cylindrical surface. A bottom portion (neighboring to the top distal end 764) of the longitudinal innermost wall surface 7613 of the hollow chamber 761 has a maximum inner transverse width w5 formed dependent on the maximum first-upright-post width W5 (namely, W5=w5) and a depth formed dependent on the maximum first-upright-post height H3; nevertheless, the above description does not therefore limit the inner curve surface shape of the longitudinal innermost wall surface 7613 of the cartridge container 7. Any other inner curve surface shape operable for expediting both of their ventilation and the temperature reduction all can be adopted. The hollow chamber 761 further respectively upwardly-and-downwardly intercommunicates between both of the top opening 7642 and the bottom opening 7622, especially in the top distal end 764 having a place where the top opening 7642 is located. Such a design that the diameter D1 of the top opening 7642 is smaller than the diameter D2 of the bottom opening 7622, can make the hollow chamber 761 being used as an air-flowing passage (or called 'flue') to expedite air ventilation, thereby accomplishing an objective of rapidly reducing temperature. Besides, the top opening 7642 located on the top distal end 764 primarily functions as providing an insertion of an external heating bar (not shown) thereinto, for heating a cartridge body material (not shown) located inside the hollow chamber 761. Preferably, by perforating through the top distal end 764 and adjacent to the top opening 7642, at least one venting aperture 7644 is formed on the top distal end 764, for further expediting both of their ventilation and the temperature reduction.

Furthermore, in the cartridge container 76 as illustrated in FIGS. 4B and 3B, the longitudinal outermost wall surface 760 is rendered as an outer curve surface which is shaped (e.g. an outer conical-frustum surface or a like-cylinder surface) in conformation to the shape of the inner curve surface of the respective corresponding first vertical pits 822; nevertheless, the above descriptions does not therefore limit what is shaped on the outer curve surface of the longitudinal outermost wall surface 760 of the cartridge container 76. Any other outer curve surface shape operable for facility of both preparation and usage thereof all can also be adopted. A wall-thickening region 765, constructed of an absolutely-dried plant fibrous body, is formed on between both of the outer curve surface of the longitudinal outermost wall surface 760 of the cartridge container 76 and the inner curve surface of the longitudinal innermost wall surface 7613 of the cartridge container 76. Furthermore, the wall-thickening region 765 has an identical cross-sectional thickness t3' formed, along the respective corresponding second longitudinal center line y2, from the top distal end 764 to the bottom distal end 762. Accordingly, the wall-thickening region 765 constructed of the absolutely-dried plant fibrous body has the following advantages of a great filtration capacity, a lower cost, a better flame retardance (i.e. a lower ignition temperature), a great oil resistance, non-occurrence of both healthy doubt and food safety problem for the human body, and conforming with FDA food-grade certification standard, thereby actually accomplishing the environmental protection requirement for both biodegradability and compostability.

Figure 6:
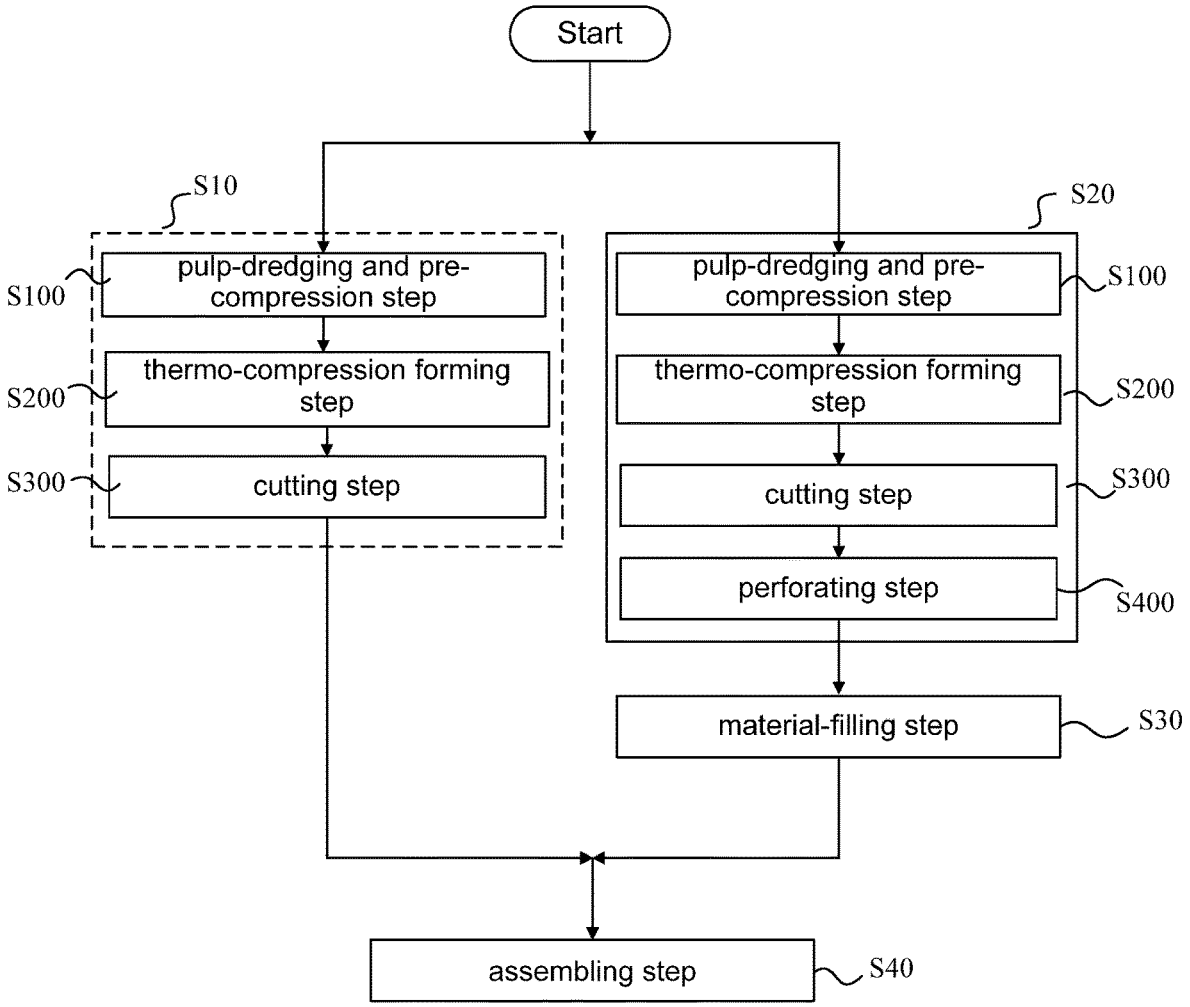
FIG. 6 depicts a flowchart of a method for preparing the electronic cigarette cartridge tube, according to a third preferred embodiment of the present invention.

Please further refer to FIG. 6 which depicts a flowchart of a method for preparing an electronic cigarette cartridge tube, according to a third preferred embodiment of the present invention. Since these steps, illustrated in FIG. 6, of the method for preparing the electronic cigarette cartridge tube actually is a mergence of both of the method steps (as illustrated in FIG. 2C) of preparing the filter tip 46 (as shown in FIGS. 3A-3B) of the electronic cigarette cartridge tube in the application of the pulp-molding production line 40 (as illustrated in FIGS. 2A-2B) of the first embodiment, and the method steps (as illustrated in FIG. 4C) of preparing the cartridge container 76 (as shown in FIGS. 5A-5B) of the electronic cigarette cartridge tube in the application of the pulp-molding production line 70 (as illustrated in FIGS. 4A-4B) of the second embodiment, a variety of component structures and their component functions used in the method (as illustrated in FIG. 6) for preparing the electronic cigarette cartridge tube all can refer to the respective embodiments illustrated in FIGS. 2A-2C and 4A-4C. Their re-descriptions will be omitted hereinafter.

As illustrated in FIG. 6, the method for preparing the electronic cigarette cartridge tube comprises the following steps.

A step S10 for integrally forming the filter tip 46 (as shown in FIGS. 3A-3B) is implemented, which comprises:

implementing the pulp-dredging and pre-compression step S100 (as shown in FIGS. 2A-2C), comprising: making the first male mold 54 sunk into the slurry tank 56 used for storing a slurry (or called 'pulp') 41, and next, only by way of vacuum exhausting of the vacuum exhausting apparatus 59 for the first male mold 64, forming the pulp 41, constructed of wet plant fibrous body, in a form of a layer evenly adsorbed onto the metallic screen 548 of an entire outer circumferential surface of each of the plurality of spaced-apart first upright posts 55 located above the first male mold 64; and next, making the first male mold 54 to be mutually matched with the first female mold 52, for pre-compressing the wet plant fibrous body positioned between the molds 52, 54, thereby integrally forming a wet paper article 42, constructed of the wet plant fibrous body, between the first female mold 52 and the first male mold 54, wherein the respective first upright posts 55 are outwardly protruded from the upper surface 540 of the first male mold 54, and a plurality of spaced-apart first vertical pits 522 are inwardly formed on from a bottom surface 520 of the first female mold 52 and have a deployed arrangement and a sized proportion both respectively corresponding to both a deployed arrangement and a sized proportion of the plurality of first upright posts 55. Each of the first vertical pits 522 and the respective corresponding first upright post 55 both mutually matched, commonly along a respective corresponding longitudinally-elongated center line Y1. The respective first upright posts 55 has a maximum first-upright-post width W2 formed perpendicular to the respective corresponding longitudinally-elongated center line Y1, a maximum first-upright-post height H2 formed parallel to the respective corresponding longitudinally-elongated center line Y1, and a ratio R2, greater than one, of the maximum first-upright-post height H2 being relative to the maximum first-upright-post width W2. The respective first vertical pits 522 has a maximum first-vertical-pit width W2' formed perpendicular to the respective corresponding longitudinally-elongated center line Y1, a maximum first-vertical-pit depth H2' formed parallel to the respective corresponding longitudinally-elongated center line Y1, and a ratio R2', greater than one, of the maximum first-vertical-pit depth H2' being relative to the maximum first-vertical-pit width W2';

after implementing the pulp-dredging and pre-compression step S100, implementing a thermo-compression forming step S200 (as shown in FIGS. 2A-2C) which comprises the steps of: positioning the paper article 42 between the second female mold 62 and the second male mold 64; and next, making the second female mold 62 and the second male mold 64 being both being mutually matched so as to thermally compress the wet paper article 42 between the molds 62, 64, and by the way of the vacuum exhausting apparatus 59 implementing the vacuum exhausting for the molds 62, 64, exhausting a larger amount of water vapor and/or moisture contained in the wet paper article 42, thereby integrally forming the dried paper article 44 constructed of a dried plant fibrous body, wherein the upper surface of the second male mold 64 is disposed with the plurality of spaced-apart second upright posts 642 which have the same deployed arrangement and the same sized proportion both as used in forming the plurality of first upright posts 55, and a bottom surface of the second female mold 62 is inwardly formed with the plurality of spaced-apart second vertical pits 622 which have the same deployed arrangement and the same sized proportion both as used in forming the plurality of first vertical pits 522; and after implementing the thermo-compression forming step S200, implementing a cutting step S300 which comprises: cutting away a superfluous portion from the dried paper article 44 to form the filter tip 46 as illustrated in FIGS. 3A and 3B. The filter tip 46 is further formed with a first top distal end 463 having a first top opening 4622 defined thereon, a first bottom distal end 467 having a first bottom opening 4642 defined thereon and opposed to the first top distal end 463, and a first hollow chamber 461 formed inside the filter tip 46 and between the first bottom distal end 467 and the first top distal end 463. The first top distal end 463 has a minimum transverse width w3' formed dependent on the minimum first-vertical-pit width W3'. The first bottom distal end 467 has a maximum transverse width w2' formed dependent on the maximum first-vertical-pit width W2'. The filter tip 46 has a maximum longitudinal height h2' formed between both the maximum first-vertical-pit height H2' and the maximum first-upright-post height H2 and between both the first top distal end 463 and the first bottom distal end 467, and a ratio, greater than one, of the maximum longitudinal height h2' of the filter tip 46 being relative to the maximum transverse width w2' of the filter tip 46.

At the same time or different time for implementing the step S10, a step S20 for integrally forming the cartridge container 76 (as illustrated in FIGS. 5A and 5B) is implemented, which comprises:

implementing the above-mentioned steps S100, S200 and S300 (as shown in FIGS. 2A-2C) in sequence, so as to integrally form the entire cartridge container 76, wherein the cartridge container 76 is further formed with a second bottom distal end 762 having a second bottom opening 7622 defined thereon and opposed to the second top distal end 764, a second top distal end 764 having a second top opening 7642 defined thereon, and a second hollow chamber 761 formed inside the cartridge container 76 and between the second bottom distal end 762 and the second top distal end 764. The second bottom distal end 762 has a maximum transverse width w4' formed dependent on the maximum first-vertical-pit width W4'. The cartridge container 76 has a maximum longitudinal height h3' formed, between both the second top distal end 764 and the second bottom distal end 762, between both the maximum first-vertical-pit height H3' and the maximum first-upright-post height H3, and a ratio, greater than one, of the maximum longitudinal height h3' being relative to the maximum transverse width w4'; and next, implementing a perforating step S400, which comprises: perforating through the second top distal end 764 of the cartridge container 76 to form at least one venting aperture 7644 communicated with the second hollow chamber 761.

Figure 7A:
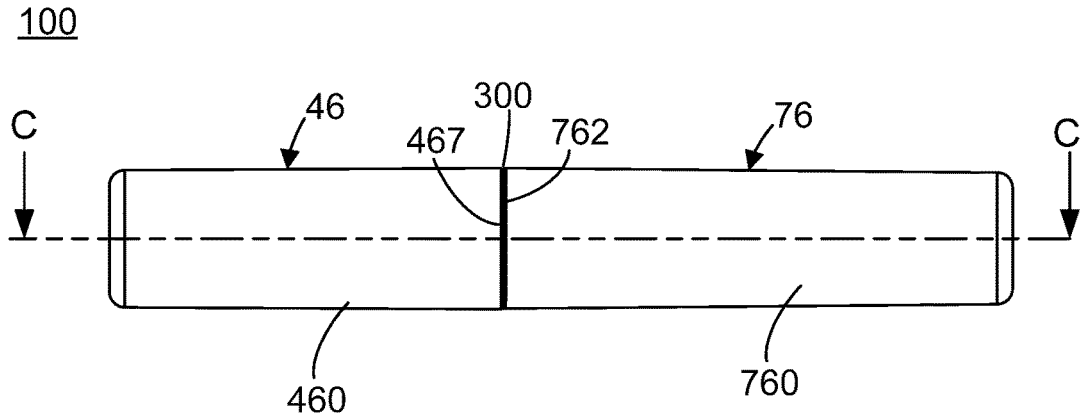
FIG. 7A depicts a perspective diagram of the electronic cigarette cartridge tube prepared by the method for preparing an electronic cigarette cartridge tube, shown in FIG. 6.
Figure 7B:
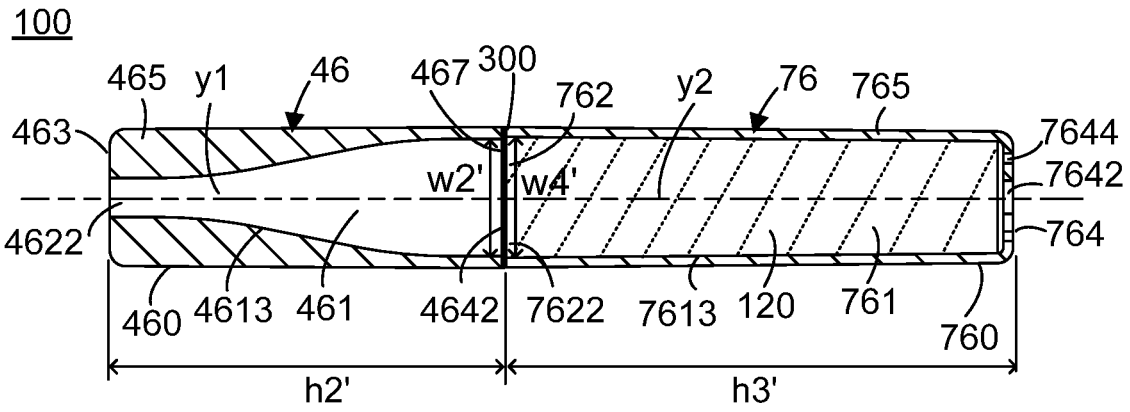
FIG. 7B depicts a laterally cross-sectional view taken along a sectioning line C-C of the electronic cigarette cartridge tube shown in FIG. 7A.

Next, a material-filling step S30 is implemented, which comprises: filling an electronic cigarette cartridge material 120, containing tobacco ingredient, from the second bottom opening of the cartridge container 76 into the second hollow chamber 761 of the cartridge container 76 (as shown in FIG. 7B).

Next, an assembling step S40 is implemented, which comprises: making the first bottom distal end 467 of the filter tip 46 being permanently end-to-end jointed to the second bottom distal end 762 of the cartridge container 76 by disposing an adhesive layer 300 adhered into between the first bottom distal end 467 and the second bottom distal end 762, thereby forming an entire electronic cigarette cartridge tube 100 (as shown in FIG. 7A). In this embodiment, depending on different demands, both of the pulp-molding production line 40 (as depicted in FIGS. 2A-2B) and the pulp-molding production line 70 (as depicted in FIGS. 4A-4B) are able to simultaneously operate in parallel so as to massively-and-automatically produce both the filter tip 46 and the cartridge container 76 at the same time and thereby save its working cycle time, or to respectively operate in series.

Further referring to FIGS. 6, 7A and 7B, FIG. 7A depicts a perspective diagram of an electronic cigarette cartridge tube 100 prepared by the method (as depicted in FIG. 6) for preparing the electronic cigarette cartridge tube, and FIG. 7B depicts a laterally cross-sectional view taken along a sectioning line C-C of the electronic cigarette cartridge tube 100 shown in FIG. 7A. Since the electronic cigarette cartridge tube 100 is to combine the filter tip 46 (illustrated in FIGS. 3A~3B) with the cartridge container 76 (illustrated in FIGS. 4A~4B), a variety of detailed structures and their functions on both of the filter tip 46 and the cartridge container 76 all can refer to the above-mentioned preferred embodiment illustrated in FIGS. 3A~3B and 5A~5B. Thus, their re-description will be omitted hereinafter. Besides, both of the filter tip 46 and the cartridge container 76 are respectively made by the identical pulp-molding fabrication method (as illustrated in FIGS. 2A~2C and 4A~4C), which includes using the male molds 54, 84 for dredging the pulp 41, and using the male and female mold assembly 52, 54, 82, 84 for applying different-pressure compression on the pulp.

As illustrated in FIGS. 7A~7B, the filter tip 46 has a first longitudinal center line y1, a first top distal end 463 formed with a first top opening 4622 thereon, and a first bottom distal end 467 formed with a first bottom opening 4642 thereon and opposed to the first top distal end 463. The first top distal end 463 has a maximum transverse width formed perpendicular to the first longitudinal center line y1. The filter tip 46 has a maximum longitudinal height h2' formed, between the first top distal end 463 and the first bottom distal end 467, parallel to the first longitudinal center line y1, and a ratio, greater than one, of the maximum longitudinal height h2' of the filter tip 46 being relative to the maximum transverse width w2' of the filter tip 46. The filter tip 46 further has a longitudinal outermost wall surface 460 formed outside the filter tip 46 and between both the first top distal end 463 and the first bottom distal end 467, a first hollow chamber 461 formed inside the filter tip 46 and respectively intercommunicating with the first top opening 4622 and the first bottom opening 4642, and a longitudinal innermost wall surface 4613 formed on constructing the first hollow chamber 461. A wall-thickening region 465 constructed of the dried plant fibrous body is formed between both the longitudinal outermost wall surface 460 and the longitudinal innermost wall surface 4613. Also, the wall-thickening region 465 is used as a filtration region which has different cross-sectional thicknesses gradually narrowed down, along the first longitudinal center line y1 from the first top distal end 463 to the first bottom distal end 467.

As illustrated in FIGS. 7A~7B, the cartridge container 76 is operable to store the electronic cigarette cartridge material 120 therein, and has a second longitudinal center line y2, a second top distal end 764 formed with a second top opening 7642 and a maximum transverse width w4' perpendicular to the respective corresponding second longitudinal center line y2, a second bottom distal end 762 formed with a second bottom opening 7622 and opposed to the second top distal end 764, a maximum longitudinal height h3' formed between both the second top distal end 764 and the second bottom distal end 762 and parallel to the respective corresponding second longitudinal center line y2, a ratio, greater than one, of the maximum longitudinal height h3' being relative to the maximum transverse width w4' of the cartridge container 76, a longitudinal outermost wall surface 760 formed between both the second top distal end 764 and the second bottom distal end 762, a second hollow chamber 761 respectively intercommunicating with both the second top opening 7642 and the second bottom opening 7622, a longitudinal innermost wall surface 7613 formed on constructing the second hollow chamber 761, and a wall-thickening region 765, which is constructed of the dried plant fibrous body, formed between both the longitudinal outermost wall surface 760 and the longitudinal innermost wall surface 7613. The wall-thickening region 765 has an identical cross-sectional thickness formed, along the second longitudinal center line y2 from the second top distal end 764 to the second bottom distal end 762. By way of collocating both the first longitudinal center line y1 and the second longitudinal center line y2 both in collinearity thereof, the second bottom distal end 467 of the filter tip 46 is permanently end-to-end jointed to the second bottom distal end 762 of the cartridge container 76 via an adhesive layer 300 which is adhered respectively to both the second bottom distal end 467 and the second bottom distal end 762. By aligning and interconnecting both the first bottom opening 4642 and the second bottom opening 7622, the first hollow chamber 461 and the second hollow chamber 761 both can be communicated with each other so as to complete an assembly of the entire electronic cigarette cartridge tube 100. Preferably, a ratio that the maximum longitudinal height h3' is relative to the maximum transverse width w4' of the cartridge container 76 is greater than 3.8, and a ratio that the maximum longitudinal height h2' is relative to the maximum transverse width w2' of the filter tip 46 is greater than 3.8. Preferably, each of the maximum transverse width w4' or w2' of each of the cartridge container 76 and the filter tip 36 is smaller than 8 mm. Preferably, the second top distal end 764 of the cartridge container 76 is further formed with at least one venting aperture 7644 communicated with the second hollow chamber 761.

Figure 8A:
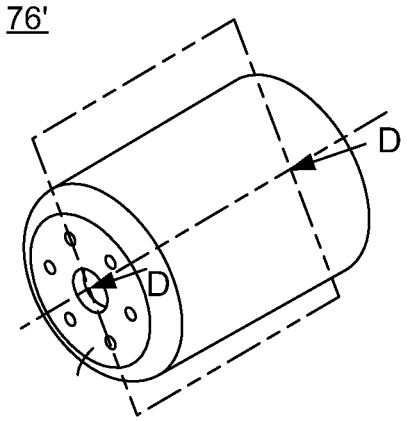
FIG. 8A depicts a perspective diagram of the cartridge container according to a fourth preferred embodiment of the present invention.
Figure 8B:
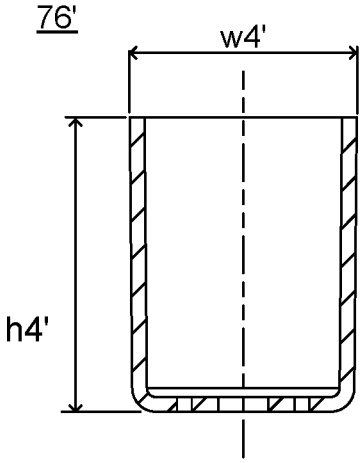
FIG. 8B depicts a laterally cross-sectional view taken along a sectioning plane D-D of the cartridge container shown in FIG. 8A.

Further referring to FIGS. 8A and 8B, FIG. 8A depicts a perspective diagram of a cartridge container 76' according to a fourth preferred embodiment of the present invention, and FIG. 8B depicts a laterally cross-sectional view taken along a sectioning plane D-D of the cartridge container 76'shown in FIG. 8A. As illustrated in FIG. 8A, a difference of the cartridge container 76' in the fourth preferred embodiment from the cartridge container 76 (illustrated in FIG. 5A) of the second preferred embodiment is that: the maximum longitudinal height h4' of the cartridge container 76' (as illustrated in FIG. 8A) in the fourth preferred embodiment is smaller than the maximum longitudinal height h3' of the cartridge container 76 (illustrated in FIG. 5A) of the second preferred embodiment, but the ratio that the maximum longitudinal height h4' is relative to the maximum transverse width w4' in the cartridge container 76' is still greater than one. Since a variety of detailed structures and their functions of the cartridge container 76' all can refer to the above-mentioned preferred embodiment illustrated in FIGS. 5A~5B, their re-description will be omitted hereinafter.

Figure 9A:
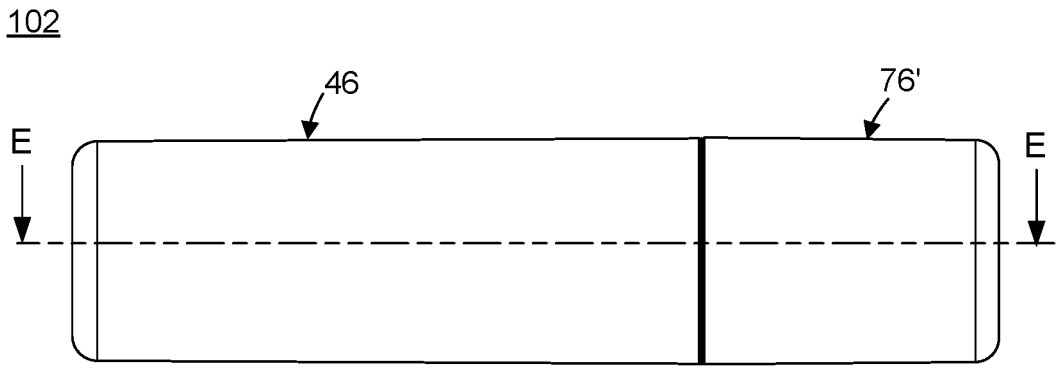
FIG. 9A depicts a perspective diagram of an electronic cigarette cartridge tube according to a fifth preferred embodiment of the present invention.
Figure 9B:
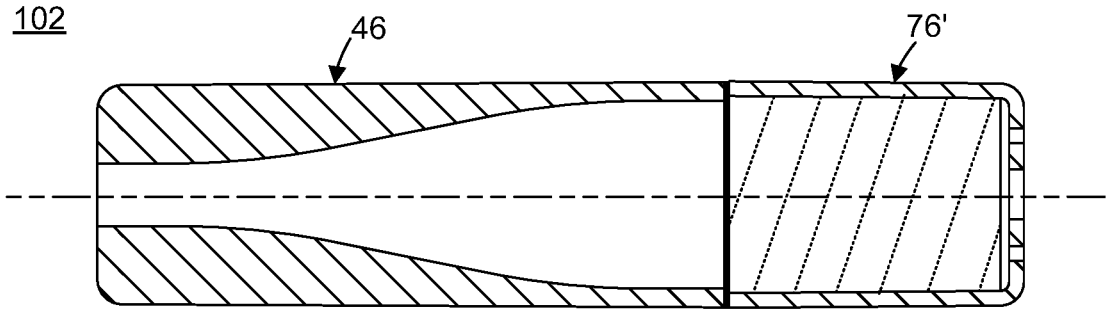
FIG. 9B depicts a laterally cross-sectional view taken along a sectioning line E-E of the electronic cigarette cartridge tube shown in FIG. 9A.

Further referring to FIGS. 9A-9B, FIG. 9A depicts a perspective diagram of an electronic cigarette cartridge tube 102 according to a fifth preferred embodiment of the present invention, and FIG. 9B depicts a laterally cross-sectional view taken along a sectioning line E-E of the electronic cigarette cartridge tube 102 shown in FIG. 9A. As illustrated in FIGS. 9A-9B, the electronic cigarette cartridge tube 102 of the fifth preferred embodiment is to actually combine the filter tip 46 (illustrated in FIGS. 3A~3B) with the cartridge container 76' (illustrated in FIGS. 8A~8B), Since a variety of detailed structures and their functions of both the filter tip 46 and the cartridge container 76' all can refer to the above-mentioned preferred embodiment illustrated in FIGS. 3A~3B and 8A~8B, their re-description will be omitted hereinafter.

The present invention effects the following technical benefits that: compared with the prior art, the electronic cigarette cartridge tube and the method for preparing the same, in accordance to the present invention, can not only resolve those technical problems of the existing pulp-molding fabrication method that is incapable of producing such an electronic cigarette cartridge tube components (e.g. a filter tip or a cartridge container) where a ratio of its maximum longitudinal height being relative to its maximum transverse width is greater than one, but can also save its working cycle time, benefit its mass production, and assure its higher product yield and quality. Furthermore, the electronic cigarette cartridge tube and the method for preparing the same, according to the present invention, treats pure plant fibers as a material for constituting the entire electronic cigarette cartridge tube. Therefore, it can achieve a great filtration capacity, a lower cost, a better flame retardance (i.e. a lower ignition temperature), a great oil resistance, and a property of easily reducing temperature, wherein the hollow chamber design, constructed with an inner curved-surface, of the electronic cigarette cartridge tube can accomplish several advantages of expediting air ventilation to rapidly reduce temperature, non-occurrence of both healthy doubt and food safety problem for the human body, and conforming with FDA food-grade certification standard, thereby actually accomplishing the environmental protection requirement for both biodegradability and compostability.

As described above, although the present invention has been described with the preferred embodiments thereof, those skilled in the art will appreciate that various modifications, additions, and substitutions are possible without departing from the scope and the spirit of the invention. Accordingly, the scope of the present invention is intended to be defined only by reference to the claims.

What is claimed is:

1. A method for preparing an electronic cigarette cartridge tube that comprises a filter tip and a cartridge container, characterized in that, the method for preparing the electronic cigarette cartridge tube comprises:

a pulp-dredging and pre-compression step comprising the steps of: sinking a first male mold within a slurry tank, and only by way of vacuum exhausting, adsorbing a wet plant fibrous body onto and around an entire outer circumferential surface of each of a plurality of spaced-apart first upright posts located on the first male mold; and then making a first female mold and the first male mold both being mutually matched for pre-compressing the wet plant fibrous body located between the first female mold and the first male mold, thereby forming a wet paper article, which is constructed of the wet plant fibrous body, located between the first female mold and the first male mold, wherein each of the first upright posts is protruded outside an upper surface of the first male mold, a plurality of spaced-apart first vertical pits are formed inwardly on from a bottom surface of the first female mold and respectively correspond to the plurality of first upright posts in a deployed arrangement and sized proportion, and each of the first vertical pits and the respective corresponding first upright post both are mutually matched, commonly along a respective corresponding longitudinally-elongated center line, such that each of the first upright posts has a maximum first-upright-post width formed perpendicular to the respective corresponding longitudinally-elongated center line, a maximum first-upright-post height formed parallel to the respective corresponding longitudinally-elongated center line, and a ratio, greater than one, of the maximum first-upright-post height being relative to the maximum first-upright-post width, and each of the first vertical pits has a maximum first-vertical-pit width formed perpendicular to the respective corresponding longitudinally-elongated center line, a maximum first-vertical-pit depth formed parallel to the respective corresponding longitudinally-elongated center line, and a ratio, greater than one, of the maximum first-vertical-pit depth being relative to the maximum first-vertical-pit width;

after the pulp-dredging and pre-compression step, implementing a thermo-compression forming step, which comprises the steps of: positioning the wet paper article into between a second female mold and a second male mold; making the second female mold and the second male mold both being mutually matched for thermally compressing the wet paper article located between the second female mold and the second male mold; and by the way of vacuum exhausting, exhausting a portion of water vapor and/or moisture contained within the wet paper article, and thereby drying the wet paper article, wherein a plurality of spaced-apart second upright posts are disposed, on an upper surface of the second male mold, with the same deployed arrangement and the same sized proportion as using in forming the plurality of first upright posts, and a plurality of spaced-apart second vertical pits are inwardly formed, from a bottom surface of the second female mold, with the same deployed arrangement and the same sized proportion as used in forming the plurality of first vertical pits; and after the thermo-compression forming step, implementing a cutting step, which comprises the steps of: cutting away a superfluous portion from the dried paper article; and by implementing the cutting step, making the dried paper article respectively forming a top distal end, a top opening on the top distal end, a bottom distal end opposite to the top distal end, and a bottom opening on the bottom distal end, wherein the bottom distal end has a maximum transverse width formed dependent on the maximum first-vertical-pit width, and the dried paper article is either of the filter tip and the cartridge container, which has a maximum longitudinal height formed, from the top distal end to the bottom distal end, between both the maximum first-vertical-pit height and the maximum first-upright-post height, and a ratio, greater than one, of the maximum longitudinal height being relative to the maximum transverse width.

2. The method for preparing the electronic cigarette cartridge tube according to claim 1, wherein each of the first upright posts has a free terminal and a junction terminal formed, with the maximum first-upright-post width, oppositely to the free terminal, and connected to the upper surface of the first male mold.

3. The method for preparing the electronic cigarette cartridge tube according to claim 2, wherein each of the first upright posts further has a longitudinal outermost wall surface which is an outer curve surface formed, with the maximum first-upright-post height, between the free terminal and the junction terminal, around the respective corresponding longitudinally-elongated center line, thereby making the dried paper article correspondingly forming a hollow chamber and a longitudinal innermost wall surface to construct the hollow chamber, between both the top distal end and the bottom distal end, after the cutting step is implemented, wherein the longitudinal innermost wall surface is an inner curve surface shaped in conformation to a shape of the corresponding outer curve surface.

4. The method for preparing the electronic cigarette cartridge tube according to claim 3, wherein each of the first vertical pits further has a longitudinal innermost wall surface which is an inner curve surface formed around the respective corresponding longitudinally-elongated center line and has the maximum first-vertical-pit height, thereby making the dried paper article correspondingly forming a longitudinal outermost wall surface, which is an outer curve surface, located between both the top distal end and the top distal end, after the cutting step is implemented, wherein the outer curve surface of the dried paper article is shaped in conformation to a shape of the inner curve surface of the respective corresponding first vertical pit, and a wall-thickening region constructed of the dried plant fibrous body is formed between both the outer curve surface and the inner curve surface of the dried paper article.

5. The method for preparing the electronic cigarette cartridge tube according to claim 4, wherein after the cutting step is implemented for the dried paper article, the filter tip is formed from the dried paper article, wherein the wall-thickening region is used as a filtration region and has different cross-sectional thicknesses gradually narrowed down, along the respective corresponding longitudinally-elongated center line, from the top distal end to the bottom distal end.

6. The method for preparing the electronic cigarette cartridge tube according to claim 4, wherein after the cutting step is implemented for the dried paper article, the cartridge container is formed from the dried paper article, wherein the wall-thickening region has an identical cross-sectional thickness formed, along the respective corresponding longitudinally-elongated center line, from the top distal end to the bottom distal end.

7. The method for preparing the electronic cigarette cartridge tube according to claim 4, wherein while the dried paper article is the filter tip, the outer curve surface of the longitudinal outermost wall surface of each of the first upright posts is a combination of cascading a smaller outer cylindrical surface, an outer conical-frustum surface and a larger outer cylindrical surface, along the respective corresponding longitudinally-elongated center line.

8. The method for preparing the electronic cigarette cartridge tube according to claim 4, wherein while the dried paper article is the cartridge container, the outer curve surface of the longitudinal outermost wall surface of each of the first upright posts is either of an outer cylindrical surface and an outer conical-frustum surface.

9. The method for preparing the electronic cigarette cartridge tube according to claim 1, wherein each of the first upright posts has a minimum first-upright-post width formed perpendicular to the respective corresponding longitudinally-elongated center line and smaller than the maximum first-upright-post width, and each of the first vertical pits has a minimum first-vertical-pit width formed perpendicular to the respective corresponding longitudinally-elongated center line, thereby making the dried paper article forming the top opening dependent on the minimum first-upright-post width, making the dried paper article forming the bottom opening dependent on the maximum first-upright-post width, and making the top distal end having a minimum transverse width formed dependent on the minimum first-vertical-pit width, after implementing the cutting step.

10. The method for preparing the electronic cigarette cartridge tube according to claim 1, wherein after the cutting step is implemented, the ratio greater than 3.8 is made.

11. The method for preparing the electronic cigarette cartridge tube according to claim 1, wherein after the cutting step is implemented, the maximum transverse width smaller than 8 mm is made.

12. The method for preparing the electronic cigarette cartridge tube according to claim 1, wherein further comprises the steps of: after implementing the cutting step for the dried paper article, forming the cartridge container from the dried paper article; and then implementing a perforating step which comprises: perforating through the top distal end of the cartridge container to form at least one venting aperture thereon.

13. A method for preparing an electronic cigarette cartridge tube that comprises a filter tip and a cartridge container, wherein the method for preparing the electronic cigarette cartridge tube comprises:

step S10 for integrally forming the filter tip, which comprises:

implementing a pulp-dredging and pre-compression step S100 that comprises the steps of: sinking a first male mold within a slurry tank, and only by way of vacuum exhausting, adsorbing a wet plant fibrous body onto and around an entire outer circumferential surface of each of a plurality of spaced-apart first upright posts located on the first male mold; and then making a first female mold and the first male mold both being mutually matched for pre-compressing the wet plant fibrous body between a first female mold and the first male mold, thereby forming a wet paper article, which is constructed of the wet plant fibrous body, located between the first female mold and the first male mold, wherein each of the first upright posts is protruded outside an upper surface of the first male mold, a plurality of spaced-apart first vertical pits are formed inwardly on from a bottom surface of the first female mold, the plurality of first vertical pits respectively correspond to the plurality of first upright posts in a deployed arrangement and sized proportion, and each of the first vertical pits and the respective corresponding first upright post both are mutually matched, commonly along a respective corresponding longitudinally-elongated center line, such that each of the first upright posts has a maximum first-upright-post width formed perpendicular to the respective corresponding longitudinally-elongated center line, a maximum first-upright-post height formed parallel to the respective corresponding longitudinally-elongated center line, and a ratio, greater than one, of the maximum first-upright-post height being relative to the maximum first-upright-post width, and each of the first vertical pits has a maximum first-vertical-pit width formed perpendicular to the respective corresponding longitudinally-elongated center line, a maximum first-vertical-pit depth formed parallel to the respective corresponding longitudinally-elongated center line, and a ratio, greater than one, of the maximum first-vertical-pit depth being relative to the maximum first-vertical-pit width;

after implementing the pulp-dredging and pre-compression step S100, implementing a thermo-compression forming step S200 which comprises the steps of: positioning the wet paper article into between a second female mold and a second male mold; making the second female mold and the second male mold both being mutually matched for thermally compressing the wet paper article located between the second female mold and the second male mold; and by the way of vacuum exhausting, exhausting a portion of water vapor and/or moisture contained within the wet paper article, and thereby forming a dried paper article constructed of the dried plant fibrous body, wherein a plurality of spaced-apart second upright posts are disposed, on an upper surface of the second male mold, with the same deployed arrangement and the same sized proportion as used in forming the plurality of first upright posts, and a plurality of spaced-apart second vertical pits are inwardly formed, from a bottom surface of the second female mold, with the same deployed arrangement and the same sized proportion as used in forming the plurality of first vertical pits; and after implementing the thermo-compression forming step S200, implementing a cutting step S300 which comprises: cutting away a superfluous portion from the dried paper article to form the filter tip, wherein the filter tip is further formed with a first top distal end having a first top opening defined thereon, and a first bottom distal end opposed to the first top distal end, having a first bottom opening defined thereon and a maximum transverse width formed dependent on the maximum first-vertical-pit width, wherein the filter tip has a maximum longitudinal height formed between both the first top distal end and the first bottom distal end and between both the maximum first-vertical-pit height and the maximum first-upright-post height, and a ratio, greater than one, of the maximum longitudinal height of the filter tip being relative to the maximum transverse width of the filter tip;

a step S20 for integrally forming the cartridge container, which comprises:

implementing the steps S100, S200 and S300 in sequence, to integrally form the cartridge container, wherein the cartridge container is further formed with a second top distal end having a second top opening defined thereon, and a second bottom distal end opposed to the second top distal end, having a second bottom opening defined thereon and a maximum transverse width, wherein the cartridge container has a maximum longitudinal height formed between the second top distal end and the second bottom distal end, and a ratio, greater than one of the maximum longitudinal height of the cartridge container being relative to the maximum transverse width of the cartridge container; and implementing a perforating step S400, which comprises: perforating through the second top distal end of the cartridge container to form at least one venting aperture thereon;

a material-filling step S30 comprising: filling electronic cigarette cartridge material, containing tobacco ingredient, from the second bottom opening into the cartridge container; and an assembling step S40 comprising: making the first bottom distal end of the filter tip being permanently end-to-end jointed to the second bottom distal end of the cartridge container, thereby forming the entire electronic cigarette cartridge tube.

14. An electronic cigarette cartridge tube comprising a filter tip and a cartridge container, both of which are respectively made by a pulp-molding fabrication method including using a male mold for absorbing pulp, and then using a male and female mold assembly for compression on the pulp, wherein:

the filter tip has a first longitudinal center line, a first top distal end formed with a first top opening and a maximum transverse width perpendicular to the first longitudinal center line, a first bottom distal end formed with a first bottom opening and opposed to the first top distal end, a maximum longitudinal height formed between both the first top distal end and the first bottom distal end and parallel to the first longitudinal center line, a ratio, greater than one, of the maximum longitudinal height of the filter tip being relative to the maximum transverse width of the filter tip, a longitudinal outermost wall surface formed outside of the filter tip and between the first top distal end and the first bottom distal end, a first hollow chamber formed inside the filter tip and respectively intercommunicating between the first top opening and the first bottom opening, a longitudinal innermost wall surface formed on constructing the first hollow chamber, and a filtration region, which is constructed of a dried plant fibrous body and formed between both the longitudinal outermost wall surface and the longitudinal innermost wall surface of the filter tip, having different cross-sectional thicknesses gradually narrowed down, along the first longitudinal center line from the first top distal end to the first bottom distal end; and the cartridge container used to store electronic cigarette cartridge material therein, has a second longitudinal center line, a second top distal end formed with a second top opening and a maximum transverse width perpendicular to the second longitudinal center line, a second bottom distal end formed with a second bottom opening and opposed to the second top distal end, a maximum longitudinal height formed between both the second top distal end and the second bottom distal end and parallel to the second longitudinal center line, a ratio, greater than one, of the maximum longitudinal height of the cartridge container being relative to the maximum transverse width of the cartridge container, a longitudinal outermost wall surface formed between both the second top distal end and the second bottom distal end, a second hollow chamber respectively intercommunicating with both the second top opening and the second bottom opening, a longitudinal innermost wall surface on constructing the second hollow chamber, and a wall-thickening region constructed of the dried plant fibrous body, having an identical cross-sectional thickness formed, between both the longitudinal outermost wall surface and the longitudinal innermost wall surface of the cartridge container, along the second longitudinal center line from the second top distal end to the second bottom distal end, wherein by collocating the first longitudinal center line and the second longitudinal center line both in collinearity thereof, the second bottom distal end of the filter tip is permanently end-to-end jointed to the second bottom distal end of the cartridge container, and by aligning and interconnecting both the first bottom opening and the second bottom opening, the first hollow chamber and the second hollow chamber both are intercommunicated with each other, to complete an assembling of the entire electronic cigarette cartridge tube.

15. The electronic cigarette cartridge tube according to claim 14, wherein the ratio that the maximum longitudinal height of the cartridge container is relative to the maximum transverse width of the cartridge container is greater than 3.8, and the ratio that the maximum longitudinal height of the filter tip is relative to the maximum transverse width of the filter tip is greater than 3.8.

16. The electronic cigarette cartridge tube according to claim 14, wherein the maximum transverse width of any one of the cartridge container and the filter tip is smaller than 8 mm.

17. The electronic cigarette cartridge tube according to claim 14, wherein the second top distal end of the cartridge container is further formed with at least one venting aperture communicated with the second hollow chamber.

18. The electronic cigarette cartridge tube according to claim 14, wherein the longitudinal innermost wall surface of the filter tip is formed with an inner curve surface which is a combination of cascading a smaller inner cylindrical surface, an inner conical-frustum surface and a larger inner cylindrical surface, along the corresponding first longitudinal center line, and the longitudinal outermost wall surface of the filter tip is formed with an outer curve surface which is either of an outer cylindrical surface and an outer conical-frustum surface.

19. The electronic cigarette cartridge tube according to claim 14, wherein the longitudinal innermost wall surface of the cartridge container is formed with an inner curve surface which is either of an inner cylindrical surface and an inner conical-frustum surface, and the longitudinal outermost wall surface of the cartridge container is formed with an outer curve surface which is either of an outer cylindrical surface and an outer conical-frustum surface.

* * * * *